US006293757B1

(12) United States Patent
Oda et al.

(10) Patent No.: US 6,293,757 B1
(45) Date of Patent: Sep. 25, 2001

(54) FLUID PUMP CONTROL APPARATUS AND METHOD

(75) Inventors: Tomihisa Oda, Susono; Takao Fukuma, Numazu; Yasuo Harada, Susono, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/227,578

(22) Filed: Jan. 8, 1999

(30) Foreign Application Priority Data

Feb. 10, 1998 (JP) ..... 10-028738

(51) Int. Cl.[7] ..... F04B 19/02

(52) U.S. Cl. ..... 417/53; 417/462; 123/456; 123/447; 123/497

(58) Field of Search ..... 417/462, 53; 123/497, 123/456, 447

(56) References Cited

U.S. PATENT DOCUMENTS

| | | | | |
|---|---|---|---|---|
| 5,176,122 | * | 1/1993 | Ito | 123/447 |
| 5,201,294 | * | 4/1993 | Osuka | 123/456 |
| 5,313,920 | | 5/1994 | Matsushita . | |
| 5,483,940 | | 1/1996 | Namba et al. . | |
| 5,609,136 | * | 3/1997 | Tuken | 123/446 |
| 5,752,486 | * | 5/1998 | Nakashima et al. | 123/447 |
| 5,819,709 | * | 10/1998 | Holmes et al. | 123/497 |
| 5,850,818 | * | 12/1998 | Yoshiume et al. | 123/497 |
| 5,884,597 | * | 3/1999 | Hiraku et al. | 123/447 |

FOREIGN PATENT DOCUMENTS

| | | | |
|---|---|---|---|
| 195 48 280 A1 | 6/1997 | (DE) . | |
| 0 501 459 A2 | 9/1992 | (EP) | 123/456 |
| 3-18645 | 1/1991 | (JP) | 123/447 |
| 6-147047 | 5/1994 | (JP) . | |
| 10318071 | 12/1998 | (JP) . | |
| 10339232 | 12/1998 | (JP) . | |
| WO 98/55761 | 10/1998 | (WO) . | |

* cited by examiner

*Primary Examiner*—Cheryl J. Tyler
(74) *Attorney, Agent, or Firm*—Oliff & Berridge PLC

(57) ABSTRACT

An amount of pressurized fluid is pumped by a high-pressure fluid pump to a common rail in an engine by using a multi-functional control circuit (ECU) that improves the controllability of fluid pumped to the common rail such that a target pressure in the common rail is achieved notwithstanding the loss of fuel injected from the common rail into the engine's cylinders nor the variety of pressure losses or deviations occurring throughout the system. The ECU sets a base fluid pumping amount based on a target value of pressure in the common rail and an amount of fluid ejected from the common rail. The ECU also calculates a fluid pumping amount required to cause the actual pressure of the common rail to follow a change of a target pressure of the common rail according to the amount of change of the target pressure. The ECU sets the sum of the basic fluid pumping amount, the required fluid pumping amount and a carried-over amount of fluid, as a set value of the fluid pumping amount to achieve target pressure in the common rail. If the set value of the fluid pumping amount exceeds a predetermined capacity of the fluid pump, the ECU sets a difference between the set value of the fluid pumping amount and the predetermined capacity as the carried-over amount of fluid that is carried over to a next setting of fluid pumping amount, thereby reflecting the difference therebetween in a next set value of the fluid pumping amount so that the target pressure in the common rail may be achieved via a plurality of pumping sequences including any carried over fluid amounts.

16 Claims, 14 Drawing Sheets

1 ···FUEL INJECTION VALVE
3 ···COMMON RAIL
5 ···INNER CAM-TYPE HIGH-PRESSURE FUEL SUPPLY PUMP
20 ···ECU

1 ···FUEL INJECTION VALVE
3 ···COMMON RAIL
5 ···INNER CAM-TYPE HIGH-PRESSURE FUEL SUPPLY PUMP
20 ···ECU (FIG. 10)

(i) TIME POINT $t_0$ $Q_H+(Q_B-Q_{MAX})$
(ii) TIME POINT $t_1$ $Q_H+2\times(Q_B-Q_{MAX})$
(iii) TIME POINT $t_2$ $Q_H+3\times(Q_B-Q_{MAX})$
(iv) TIME POINT $t_3$ 0

FLUID PUMP CONTROL APPARATUS AND METHOD

INCORPORATION BY REFERENCE

The disclosure of Japanese Patent Application No. HEI 10-28738 filed on Feb. 10, 1998 including the specification, drawings and abstract is incorporated herein by reference in its entirety.

BACKGROUND OF THE INVENTION

1. Field of the Invention

The present invention relates to an apparatus and a method for controlling a fluid pump.

2. Description of the Related Art

There is known a common rail-type fuel injection apparatus wherein a common rail (pressure accumulating chamber) for storing high pressure fuel is provided and a fuel injection valve is connected to the common rail so that fuel is injected into an internal combustion engine.

In the common rail-type fuel injection apparatus, the rate of fuel injection from the fuel injection valve varies in accordance with the common rail pressure, that is, the pressure inside the common rail. Therefore, it is necessary to control the common rail pressure with high precision so that an optimal fuel injection rate can be achieved in accordance with the engine operating conditions.

The common rail pressure is controlled typically by controlling the amount of fuel ejected, i.e., the fuel pumping amount, from a high-pressure fuel supply pump that supplies fuel to the common rail. A plunger-type pump is normally used as the high-pressure fuel supply pump.

In the common rail-type fuel injection apparatus, high pressure fuel stored in the common rail is injected into cylinders from fuel injection valves provided separately for the individual cylinders. Therefore, the pressure in the common rail decreases every time fuel injection is performed. Consequently, there is a need for a fuel pump control apparatus to cause the fuel pump to pump a required amount to the common rail after each fuel injection so as to hold the pressure in the common rail at a target pressure. Moreover, in actual operation, the target common rail pressure itself is sharply varied over a wide range in accordance with the operating condition of the engine during transitional operation, during which the engine operating condition sharply changes. Therefore, during the transitional period, the fuel pump control apparatus needs to control the amount of fuel to be pumped out from the fuel pump, i.e., fuel pumping amount, so as to prevent the pressure in the pressure accumulating chamber from overshooting or undershooting following changes in the target pressure, that is, so as to achieve good controllability of the pressure in the pressure accumulating chamber.

The plunger pump used as the common rail-type fuel pump is normally an inner cam-type plunger pump as shown in FIG. 11. Since the fuel pump needs to pump fuel for the fuel injection into each cylinder of the engine, the number of times of pumping out fuel during one revolution of the pump needs to correspond to the number of cylinders. The pump shown in FIG. 11 has four cam lobes and four plungers. In the pump shown in FIG. 11, the plungers simultaneously pump out and draw in fuel during each cycle, that is, 90° rotation of the pump drive shaft. Therefore, the fuel pump pumps out fuel four times per revolution. In four-stroke engines, the fuel injection into all the cylinders is completed in two engine revolutions. Consequently, the pump shown in FIG. 11 can be used for a four-stroke eight-cylinder engine by driving the pump at the revolution speed equal to that of the crank shaft. The pump can also be used for a four-stroke four-cylinder engine by driving the pump at half the revolution speed of the crank shaft. However, with the four cam lobes of the inner cam as shown in FIG. 11 for driving the plungers, it becomes necessary to set a large changing rate of the cam profile of each cam lobe, which results in greater fluctuation of the pump driving torque. Greater fluctuation of the pump driving torque increases the load on the component parts of the pump driving system, such as the chain or the belt, and therefore may reduce the service life of the pump driving system.

In order to reduce the pump driving torque fluctuation, it is necessary to reduce the number of cam lobes and therefore reduce the changing rate of the cam profile. FIG. 2 shows a two-lobe cam pump in which the number of cam lobes is reduced to two. This cam pump has four plungers, and it is designed so that each oppositely positioned pair of cam lobes simultaneously perform pumping and intake strokes. Each plunger operates at cycles of 180° rotation of the pump drive shaft. With two pairs of plungers, the pump device pumps out fuel four times per rotation of the pump.

As for the method for controlling the amount pumped out of a plunger pump, there are known a pre-stroke adjusting method and an intake adjusting method.

The pre-stroke adjusting method controls the amount pumped from each plunger by holding the intake valve for each plunger at an open position until an intermediate stage of the pumping stroke of the plunger. More specifically, in the pre-stroke adjusting method, each plunger draws an amount of fuel corresponding to the entire stroke of the plunger into the corresponding cylinder during the intake stroke. In an early stage of the pumping stroke, a certain amount of taken-in fuel is discharged from the cylinder through the intake valve. After the intake valve is closed during the pumping stroke, the amount of fuel contained in the cylinder at that time is pressurized by the plunger. When a predetermined fuel pressure is reached, an ejection valve urged by a spring is forced to open, so that fuel is pumped into the common rail.

The intake adjusting method draws a necessary amount of fuel into each cylinder by closing the intake valve for each plunger at an intermediate stage of the intake stroke. Therefore, the entire amount of fuel drawn into each cylinder is ejected from the cylinder during the pumping stroke.

Since the pre-stroke adjusting method closes each intake valve during the pumping stroke, the method needs to employ intake valves designed for use under higher pressures than the intake valves employed by the intake adjusting method. Thus, the cost of the apparatus for the pre-stroke adjusting method becomes comparatively high. Moreover, in the pre-stroke adjusting method, a surplus of the amount of fuel drawn into each cylinder must be discharged from the cylinder by using the corresponding plunger in the early stage of the pumping stroke. Therefore, the pre-stroke adjusting method has a danger of increasing the pump driving power loss, in comparison with the intake adjusting method.

Therefore, it is preferable that the common rail fuel pump be a two-lobe cam pump, which reduces the driving torque fluctuation, and the amount of fuel to be pumped out of the cam pump be controlled by the intake adjusting method, which reduces the apparatus cost and the power loss.

However, the combination of a two-lobe cam pump and the intake adjusting method conventionally causes the problem of deterioration of responsiveness in the common rail pressure control.

Whereas the pre-stroke adjusting method determines the amount of fuel to be pumped from each plunger on the basis of the intake valve closing timing during the pumping stroke of the plunger, the intake adjusting method determines the amount of fuel to be pumped from each plunger on the basis of the intake valve closing timing, i.e., the intake valve open period, during the intake stroke of the plunger. Therefore, the pre-stroke adjusting method allows control of the pumping amount in accordance with the engine operating condition and the common rail pressure immediately before the start of pumping, that is, immediately before the start of closing the intake valve. On the other hand, the intake adjusting method necessitates determining the pumping amount in an early stage of the intake stroke. Therefore, in the intake adjusting method, a time interval between the determination of the pumping amount and the actual start of pumping becomes long. If, during the time interval, the engine operating condition or the common rail pressure changes, such a change may not be able to be reflected in the pumping amount.

This problem with the intake adjusting method becomes more significant if the method is applied to a two-lobe cam pump. With reference to FIG. 12, problems with a common rail-type fuel injection apparatus for a four-stroke four-cylinder engine employing a two-lobe cam pump controlled by the intake adjusting method will be described below.

In the chart of FIG. 12, line (A) indicates changes in the common rail pressure. The common rail pressure decreases in accordance with the amount of fuel injected, at every fuel injection into each cylinder. Subsequently, the common rail pressure is increased by the fuel pump pumping fuel to the common rail. In FIG. 12, points indicated by #1, #3, #4 indicate pressure drops due to three consecutive fuel injecting operations for first, third and fourth cylinders, respectively. Vertical lines $T_1$, $T_2$, $T_3$ indicate time points of setting amounts of fuel to be pumped from the fuel pump, where the interval between $T_1$, and $T_2$ and the interval between $T_2$ and $T_3$ are 180° in terms of crank shaft revolution angle. Line (B) indicates the target pressure PCTRG in the common rail. The target common rail pressure is set in accordance with the engine operating condition, at the time of setting an amount of fuel to be pumped.

According to a typical conventional fuel pump control, the fuel pumping amount is determined as the sum of a feed forward amount that is determined by a fuel injection amount instruction value and the common rail pressure at the time of setting a pumping amount, and a feedback amount that is determined by the difference between the target common rail pressure and the actual common rail pressure at the time of setting the pumping amount.

Lines (C) in FIG. 12 indicate stroke cycles of two pairs of plungers of an intake adjusting-type two-lobe cam pump. Since the two-lobe cam pump for a four-stroke four-cylinder engine is rotated at half the speed of that of the engine crank shaft, the two pairs of plungers (plunger group A and plunger group B) alternately pump out fuel at every 180° of crank shaft rotational angle.

Line (D) in FIG. 12 indicates stroke cycles of a pre-stroke adjusting-type four-lobe cam pump. The four-lobe cam pump is driven at half the revolution speed of the crank shaft, so that the four-lobe cam pump pumps out fuel at every 180° crank revolution.

As indicated by line (D) in FIG. 12, the four-lobe cam pump completes one stroke cycle of pumping and intake strokes at every 180° crank angle revolution. The pumping amount is determined by the intake valve closing timing during the pumping stroke. Therefore, the amount of fuel calculated at time point $T_1$ in FIG. 12 is completely pumped out at time point $P_1$ indicated on line (D). The amount of fuel to be pumped out is set in accordance with the common rail pressure at time point $T_1$ and the fuel injection amount instruction value at that time point (that is, the amount of fuel to be injected into the first cylinder), and the difference between the target pressure PCTRG and the actual pressure $PC_1$ at time point $T_1$, as stated above. Therefore, when the pumping of fuel is completed at time point $P_1$, the common rail has been supplied with an amount of fuel that completely compensates for the common rail pressure fall due to the fuel injection into the first cylinder and the deviation of the actual common rail pressure from the target pressure occurring at time point $T_1$. Consequently, at time point $P_1$, the actual common rail pressure becomes precisely equal to the target pressure PCTRG.

In the intake adjusting-type two-lobe cam pump, the stroke cycle of each plunger is 180° as indicated by line (C). The pumping fuel amount set at time point $T_1$ is taken in by the intake stroke of the plunger group A, and supplied to the common rail at time point $P_1'$ indicated on line (C), which follows the end of fuel injection into the third cylinder after the fuel injection into the first cylinder. Thus, the pumping fuel amount set on the basis of the conditions occurring at time point $T_1$ has not been supplied to the common rail before the next time point ($T_2$) for setting an amount of fuel to be pumped. More specifically, the timing of the effect of the pumping amount setting is delayed 180°, compared with the timing in the four-lobe cam pump.

Moreover, in the case of the two-lobe cam pump, the fuel pumping by the plunger group B occurs during the period between the pumping amount setting time point $T_1$ for the plunger group A and the time point $P'_1$ of completion of actual fuel supply from the plunger group A. Therefore, the actual common rail pressure at the time of completion of fuel pumping from the plunger group A differs from the common rail pressure at time point $T_1$. Consequently, if the conventional feed forward/feedback control is performed using the intake adjusting-type two-lobe cam pump, the controllability of the common rail pressure at the time of a change of the target fuel pressure deteriorates so that the common rail pressure becomes likely to overshoot or undershoot.

This problem will be described with reference to FIG. 14.

The diagram of FIG. 14 indicates changes in the target and actual common rail pressure where the feed forward control and the feedback control based on the deviation of the actual common rail pressure from the target pressure is performed using an intake adjusting-type two-lobe cam pump, according to the conventional art. In FIG. 14, $t_0$ through $t_8$ indicate the timing of pumping fuel from the fuel pump; PCTRG indicates a change in the target common rail pressure, i.e., an instruction value; and PC indicates changes in the common rail pressure occurring if the amount of fuel pumped from the fuel pump is controlled by the conventional feed forward/feedback control. In FIG. 14, it is assumed that the target common rail pressure PCTRG is greatly changed from $PCTRG_0$ to $PCTRG_1$, and that the target value PCTRG remains constant and equal to the common rail pressure up to $t_0$.

If the target common rail pressure is changed at time point $t_1$, the feedback amount TFBK is set in accordance with the difference $\Delta P_0$ between the changed target pressure $PCTRG_1$ and the actual common rail pressure $PCTRG_0$. On the other hand, the feed forward amount TFBSE is set in accordance with the changed target pressure. If the target pressure is not changed, the value of the feed forward amount TFBSE is maintained. If the target pressure is changed at time point $T_1$, the pumping amount from the fuel pump is changed in accordance with the change in the target pressure. However, since the target pressure change is actually large, the set fuel pumping amount considerably exceeds a predetermined maximum fuel pumping amount $Q_{MAX}$, that is, the entire amount of fuel required cannot be supplied by one fuel pumping operation. Since the fuel pumping operation must be performed a plurality of times to supply the required amount of fuel, the actual common rail pressure is increased stepwise after the target pressure is changed. Although the actual pressure increasing pattern is different from the pressure increasing pattern indicated in FIG. 14 since fuel injection is performed during the fuel pumping operation, the common rail pressure fluctuation due to fuel injection is ignored in the diagram of FIG. 14 to simplify the illustration.

In the intake adjusting-type two-lobe cam pump, the time point of setting a fuel pumping amount and the time point of actually pumping out fuel from a plunger group are interposed by the pumping of fuel from the other plunger group. If the common rail pressure is increased stepwise as indicated in FIG. 14, the amount of fuel set on the basis of, for example, the pressure difference $\Delta P_3$ at time point $t_3$, is actually pumped out of a plunger group at time point $t_5$, and the fuel pumping from the other plunger group is performed at the intervening time point $t_4$. As a result, the common rail pressure occurring at time point $t_5$ becomes higher than that occurring at the fuel pumping amount setting time point ($t_3$). More specifically, the amount of fuel supplied to the common rail by the fuel pumping operation performed at time point $t_5$ corresponds to the pressure difference $\Delta P_3$ occurring at time point $t_3$ in FIG. 14, which is considerably greater than the pressure difference $\Delta P_4$ occurring immediately before the actual fuel pumping operation at time point $t_5$. Therefore, the operation of setting a pumping amount at time point $t_3$ and pumping the set amount of fuel at time point $t_5$ causes the common rail pressure to exceed the target pressure, that is, causes an overshoot. In fact, at the next fuel pumping ($t_6$), the actual common rail pressure exceeds the target pressure, so that the fuel pumping amount must be reduced. Nevertheless, at time point $t_6$, the amount of fuel set on the basis of the pressure difference $\Delta P_4$ at time point $t_4$ is pumped out, so that the common rail pressure further increases, that is, overshoots. Since there is a difference between the common rail pressure at the time of setting a fuel pumping amount and the common rail pressure at the time of actually pumping the set amount of fuel, an overshoot of the common rail pressure is followed by an undershoot ($t_8$) at the time of the next or later fuel pumping operation. Furthermore, the common rail pressure may hunt, so that the controllability of the common rail fuel pressure may deteriorate. Although deterioration of the controllability can be reduced to some extent by changing the gain in the feedback control in accordance with the engine operating condition as in the related-art apparatus, it is still difficult to sufficiently reduce or prevent the aforementioned overshoot or undershoot according to the related art.

Deterioration of the controllability of the common rail pressure, especially, overshoot of the common rail pressure, is unfavorable because such an event is likely to lead to an increase of engine noise and deterioration of emissions control.

Although the problems of the related art have been described with regard to the case where an intake adjusting-type two-lobe cam pump is used for the common rail in a four-cylinder engine, similar problems may also occur in engines having other numbers of cylinders. That is, if an intake adjusting-type two-lobe cam pump is used in a common rail-type fuel injection apparatus in an engine, the problems of deterioration of controllability of the common rail pressure may occur at the time of transitional operation of the engine.

SUMMARY OF THE INVENTION

Accordingly, it is an object of the present invention to provide an apparatus and a method for controlling the fluid pumping amount of a fluid pump that is applicable to a case where an intake adjusting-type two-lobe cam pump is used to supply fluid to a common rail, and that can improve the controllability of common rail pressure and prevent overshoot and undershoot at the time of a change in the common rail pressure.

To achieve the aforementioned and other objects, a first aspect of the invention provides a fluid pump control apparatus for pumping fluid to a pressure accumulating chamber that holds pressurized fluid. The control apparatus includes a first control device for setting a basic fluid pumping amount to be pumped by the fluid pump on the basis of a target value of pressure in the pressure accumulating chamber, a second control device for calculating a fluid pumping amount required to bring pressure in the pressure accumulating chamber from a present level to the target value, a setting device for setting a sum of amount of fluid that includes the required fluid pumping amount calculated by the second control device, and the basic fluid pumping amount of the fluid pump set by the first control device, as a set value of the fluid pumping amount to be pumped by the fluid pump, and a carried-over amount setting device. If the value of fluid pumping amount set by the setting device exceeds a predetermined fluid pumping amount of the fluid pump, the carried-over amount setting device sets an amount by which the set value of fluid pumping amount exceeds the predetermined fluid pumping amount, as a carried-over amount that is carried over to the next setting of a fluid pumping amount. The total required amount of fluid may be a sum of the required fluid pumping amount and the carried-over amount.

In this control apparatus, the second control device calculates the fluid pumping amount required to bring the pressure in the pressure accumulating chamber from the present level to the changed target pressure, on the basis of the amount of change of the target pressure from the previous set target pressure value. For example, if the target pressure is increased, an amount of fluid to increase the pressure in the pressure accumulating chamber to the target pressure becomes necessary, in addition to the amount of fluid (corresponding to the basic fluid pumping amount) to offset the amount of fluid that flows out of the pressure accumulating chamber for fluid injection so as to maintain a constant pressure in the pressure accumulating chamber. The required fluid pumping amount is determined by the amount of change of the target pressure. Based on the amount of change of the target pressure, the second control device calculates the required fluid pumping amount. The setting device sums the basic fluid pumping amount calculated by the first control device and the required fluid pumping amount calculated by the second control device, and thus sets a set value of fluid pumping amount of the pump. If the set value of fluid pumping amount can be pumped to the pressure accumulating chamber by one pumping stroke, the pressure in the pressure accumulating chamber is brought to the target pressure by the single fluid pumping operation. However, if the set value of fluid pumping amount is greater than the maximum fluid pumping amount of the pump, as in an example indicated in FIG. 14, the entire amount of fluid corresponding to the set value cannot be pumped from the pump by one fluid pumping stroke. Therefore, in the invention, an amount of the required fluid pumping amount that should be pumped but cannot be pumped by the present pumping stroke (that is, an amount in excess of the maximum fluid pumping amount) is carried over to the next fluid pumping operation, that is, the carried-over amount is added to a value of fluid pumping amount in the next setting operation.

FIG. 13 illustrates an example where the pressure in the pressure accumulating chamber is changed, according to the invention, in response to the same change of the target pressure in the pressure accumulating chamber as in the example in FIG. 14. In FIG. 13, it is assumed that at time point $t_0$, there occurs a difference $\Delta P_0$ between the target value $PCTRG_1$ of pressure in the pressure accumulating chamber and the actual pressure $PCTRG_0$ in the pressure accumulating chamber, and that a fluid pumping amount $Q_H$ is required to increase the pressure in the pressure accumulating chamber following the change of the target pressure value. It is also assumed that in this case, the setting device sets a set value of fluid pumping amount as $Q_0$ ($Q_0=Q_H+Q_B$) where $Q_B$ represents the basic fluid pumping amount, and that the set value $Q_0$ of fluid pumping amount is greater than the maximum fluid pumping amount $Q_{MAX}$ of the pump. In this case, after time point $t_0$ ($t_1$ and later), the required fluid pumping amount calculated by the second control device becomes zero since the target pressure in the pressure accumulating chamber is not changed after time point $t_0$. Therefore, the set value of fluid pumping amount becomes the sum of the basic fluid pumping amount and the carried-over amount at time point $t_1$ and later. Consequently, if the basic fluid pumping amount $Q_B$ remains unchanged, the carried-over amount set by the carried-over amount setting device becomes:

$$Q_0-Q_{MAX}=Q_H+(Q_B-Q_{MAX}) \text{ at time point } t_0;$$

$$Q_B+Q_0-2\times Q_{MAX}=Q_H+2\times(Q_B-Q_{MAX}) \text{ at time point } t_1;$$

$$2\times Q_B+Q_0-3\times Q_{MAX}=Q_H+3\times(Q_B-Q_{MAX}) \text{ at time point } t_2;$$

$$3\times Q_B+Q_0-4\times Q_{MAX}=Q_H+4\times(Q_B-Q_{MAX}) \text{ at time point } t_3:$$

Since $Q_B<Q_{MAX}$, the carried-over amount decreases after every fluid pumping operation as indicated above. For example, at time point $t_3$ in FIG. 13, if the sum $Q_B+(Q_H+4\times(Q_B-Q_{MAX}))$ of the carried-over amount $Q_H+4\times(Q_B-Q_{MAX})$ and the basic fluid pumping amount $Q_B$ becomes less than the maximum fluid pumping amount $Q_{MAX}$, the carried-over amount for the next operation becomes zero. That is, by pumping out a fluid pumping amount $Q_5$ set at this stage (that is, the fluid pumping amount pumped at time point $t_5$), the entire amount of fluid required to increase the pressure in the pressure accumulating chamber to the changed target pressure will have been supplied to the pressure accumulating chamber. That is, in the invention, once a fluid pumping amount $Q_H$ required to be additionally supplied in order to increase the pressure in the pressure accumulating chamber from the present level to a changed target pressure is calculated on the basis of the amount $\Delta P_0$ of the change of the target pressure at the time of the change, the calculation of a required fluid pumping amount will not be performed again despite changes in the actual pressure in the pressure accumulating chamber, unless the target pressure is changed again. If the required fluid pumping amount thus set exceeds the maximum fluid pumping amount of the pump, that is, if the entire required fluid pumping amount cannot be supplied by one fluid pumping stroke, the required fluid pumping amount that cannot be pumped out by the present pumping stroke is carried over for the next fluid pumping stroke. Through this operation, even if a difference occurs between the pressure in the pressure accumulating chamber at the time of setting the fluid pumping amount and the pressure at the time of actually pumping the fluid pumping amount, the exact amount $Q_H$ of fluid required to increase the actual pressure in the pressure accumulating chamber to the target pressure will be eventually supplied to the pressure accumulating chamber by a plurality of fluid pumping strokes (four pumping strokes at time points $t_2$ to $t_5$ in the example of FIG. 13). If the target pressure is changed after the change at time point $t_0$, unlike the example in FIG. 13 where the target pressure remains unchanged after the change at time point $t_0$, a new required fluid pumping amount is calculated by the second control device, and reflected in the total fluid pumping amount. If the total required fluid amount is large, the new required fluid pumping amount calculated by the second control device is added to the amount carried over up to the present operation, and the control similar to that described above is conducted. Therefore, even if the actual pressure in the pressure accumulating chamber differs between the time of setting the fluid pumping amount and the time of actually pumping the fluid pumping amount, as in the case of an intake adjusting-type two-lobe cam pump, the control apparatus of the invention eliminates overshoot and undershoot, and causes the actual pressure in the pressure accumulating chamber to converge to the target pressure in a reduced length of time, thereby considerably improving the controllability of the common rail pressure.

In the invention, if the total required amount of fluid set by summing the required fluid pumping amount calculated by the second control device and the carried-over amount set at the time of previous fluid pumping amount setting operations is less than a predetermined value, the setting device may set the basic fluid pumping amount by the first control device as a set value of fluid pumping amount, and the carried-over amount setting device may set the carried-over amount to zero.

In this optional construction, if the total required amount of fluid calculated by the second control device is less than the predetermined amount, the total required amount of fluid is not reflected in the actual fluid pumping amount. The total required amount of fluid becomes small in a case where the target pressure change is small and the difference between the target pressure and the actual pressure in the pressure accumulating chamber is small. If a small total required amount of fluid is reflected in the fluid pumping amount every time such a total required amount of fluid occurs, the pressure in the pressure accumulating chamber may become unstable and undergo hunting. Therefore, to prevent hunting, the control apparatus of the invention stops the fluid pumping amount control based on the total required amount of fluid if the total required amount of fluid is sufficiently small, that is, if the pressure in the pressure accumulating chamber can be substantially kept at the target pressure merely through the control performed by the first control device.

The fluid pump control apparatus of the invention may further include a third control device for setting a feedback correction amount for a fluid pumping amount on the basis of a present target value of pressure in the pressure accumulating chamber and a present actual pressure in the pressure accumulating chamber, in such a manner that the actual pressure in the pressure accumulating chamber becomes substantially equal to the target value, wherein the third control device sets the feedback correction amount so that the feedback correction amount becomes smaller if the required fluid pumping amount equals or exceeds a predetermined amount and the total required amount of fluid equals or exceeds a predetermined amount than if the total required amount of fluid is less than the predetermined amount. If the total required amount of fluid equals or exceeds the predetermined amount, the setting device sets as the set value of fluid pumping amount a sum of the basic fluid pumping amount set by the first control device, the total required amount of fluid, and the feedback correction amount.

The third control device is provided for correcting the fluid pumping amount so that the actual pressure in the pressure accumulating chamber becomes substantially equal to the target pressure. The required fluid pumping amount calculated by the second control device is determined only by the amount of change of the target pressure at the time of the change, whereas the feedback correction amount calculated by the third control device is determined by the pressure in the pressure accumulating chamber occurring at the time of setting the fluid pumping amount. Therefore, if the control based on the total required amount of fluid and the feedback control by the third control device are simultaneously performed, interference therebetween may occur so that the pressure in the pressure accumulating chamber may fluctuate. Therefore, to prevent interference between the two controls, the control apparatus of the invention reduces the influence of the feedback control by the third control device on the fluid pumping amount, while the control based on the total required amount of fluid is being performed (that is, if the total required amount of fluid is equal to or greater than the predetermined amount).

According to another aspect of the invention, there is provided a fluid pump control apparatus for pumping pressurized fluid to a pressure accumulating chamber connected to a fluid injection valve of an internal combustion engine, the fluid pump control apparatus including a feedback control device for setting the fluid pumping amount to be pumped by the fluid pump on the basis of a target value of pressure in the pressure accumulating chamber and the actual pressure in the pressure accumulating chamber, in such a manner that the actual pressure in the pressure accumulating chamber becomes substantially equal to the target value, and a prediction device for calculating a pressure in the pressure accumulating chamber that occurs before start of the next fluid pumping operation, on the basis of a fluid injection amount, the fluid pumping amount, and the pressure in the pressure accumulating chamber occurring before the start of the present fluid pumping operation. The feedback control device uses the pressure in the pressure accumulating chamber predicted by the prediction device, instead of the actual pressure in the pressure accumulating chamber, to set the fluid pumping amount to be pumped by the next operation.

In this fluid pump control apparatus, a pressure in the pressure accumulating chamber before the start of the next fluid pumping operation (that is, after the end of the present fluid injection and the present fluid pumping operation) is predicted. By using the predicted value and the target value, the fluid pumping amount is feedback-controlled. If the interval between the time of calculating the fluid pumping amount and the time of actually pumping the fluid pumping amount is long, the calculated fluid pumping amount and the fluid pumping amount actually required may differ greatly. In the example indicated in FIG. 12, for example, the fluid pumping amount regarding the plunger group A calculated at time point $T_1$ is based on the target value of pressure in the pressure accumulating chamber and the actual pressure therein occurring at time point $T_1$. If the difference between the target value and the actual pressure is large at time point $T_1$, the fluid pumping amount also becomes large. However, the fluid pumping amount set at time point $T_1$ is not actually supplied to the pressure accumulating chamber until time point $P'_1$. If the fluid pumping amount regarding the plunger group B following the fluid injection into the first engine cylinder (that is, present fluid pumping amount) is large, the pressure in the pressure accumulating chamber occurring before the start of the next fluid pumping operation (the pressure at time point $T_2$) becomes closer to the target pressure than the pressure occurring at time point $T_1$. If the fluid pumping amount is pumped by the plunger group A, the pressure in the pressure accumulating chamber will increase more than necessary. To avoid this problem, the control apparatus of the invention calculates, at time point $T_1$, the pressure in the pressure accumulating chamber expected to occur after the present fluid injection (into the first cylinder) and the immediately subsequent fluid pumping operation by the plunger group B are completed, that is, the pressure in the pressure accumulating chamber expected to occur at time point $T_2$, as a predicted value. Through feedback control of the fluid pumping amount by using the predicted value of the pressure in the pressure accumulating chamber expected to occur at time point $T_2$ and the target value of pressure in the pressure accumulating chamber, the pressure in the pressure accumulating chamber at the end of the next pumping operation (time point $P'_1$) is controlled precisely to the target pressure.

In this control apparatus, the feedback control device may use the actual pressure in the pressure accumulating chamber to set the fluid pumping amount to be pumped by the next operation, if a deviation of the actual pressure in the pressure accumulating chamber from the target value is smaller than a predetermined value.

That is, if the actual pressure in the pressure accumulating chamber becomes close to the target value, the feedback control is performed by using the actual pressure in the pressure accumulating chamber, instead of using the predicted value of pressure in the pressure accumulating chamber. Since the predicted value of pressure in the pressure accumulating chamber contains a prediction error, the predicted value may not become equal to the target value when the actual pressure becomes equal to the target value. If the feedback control based on the predicted value is continued in such a case, the pressure in the pressure accumulating chamber may be controlled to a pressure value deviating from the target value by the amount of prediction error. To avoid such an undesired event, the fluid pump control apparatus of this invention performs the feedback control based on the actual pressure in the pressure accumulating chamber if the actual pressure becomes close to the target pressure (for example, if the actual pressure comes within the range of predicted error). Through this operation, the actual pressure in the pressure accumulating chamber precisely converges to the target pressure.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the present invention will be described in detail hereinafter with reference to the accompanying drawings.

Figure 1:
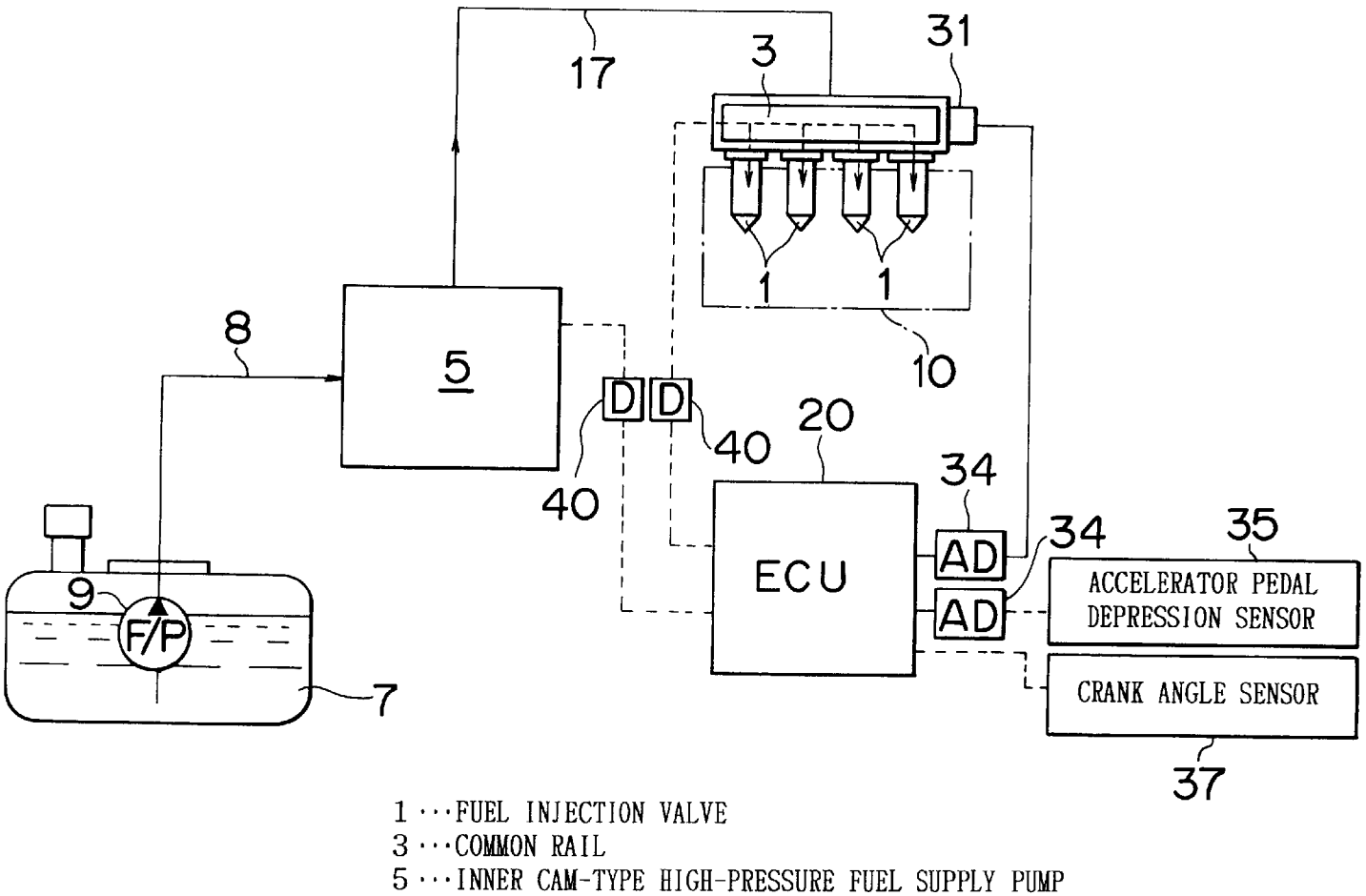
FIG. 1 is a schematic diagram illustrating a fuel pump control apparatus of the invention applied to a common rail-type fuel injection apparatus of an automotive internal combustion engine.

FIG. 1 is a schematic diagram of an embodiment of the invention applied to an automotive diesel engine.

Referring to FIG. 1, an engine 10 (a four-cylinder diesel engine in this embodiment) has fuel injection valves 1 that directly injects fuel into corresponding cylinders of the engine 10. The fuel injection valve 1 is connected to a common pressure accumulating chamber (common rail) 3. The common rail 3 holds pressurized fuel supplied thereto from an inner cam-type high-pressure fuel supply pump 5 (hereinafter, referred to as "high-pressure pump") described later, and distributes pressurized fuel to the fuel injection valves 1.

Fuel for the engine 10 (diesel oil in this embodiment) is reserved in a fuel tank 7, and supplied therefrom to the high-pressure fuel pump 5 through a low-pressure pipe 8 by a low-pressure feed pump 9, as shown in FIG. 1. Ejected from the high-pressure fuel pump 5, fuel is supplied to the common rail 3 through a high-pressure pipe 17. Fuel is then injected from the common rail 3 through the fuel injection valves 1 into the corresponding cylinders of the engine 10.

An engine control circuit (ECU) 20 for controlling the engine 10 is formed as a microcomputer in which a read-only memory (ROM), a random access memory, a microprocessor (CPU), and input/output ports are interconnected by a bidirectional bus as in a known construction. The ECU comprises a first control means for setting a basic fluid pumping amount to be pumped by the fluid pump on a basis of a target value of pressure in the pressure accumulating chamber; a second control means for calculating a required fluid pumping amount required to adjust pressure in the pressure accumulating chamber from a present level to the target pressure; a setting means for setting a sum of a total required amount of fluid that includes the required fluid pumping amount calculated by the second control means and the basic fluid pumping amount of the fluid pump set by the first control means, as a set value of fluid pumping amount to be pumped by the fluid pump; a carried-over amount setting means for, if the set value of fluid pumping amount set by the setting means exceeds a predetermined fluid pumping amount of the fluid pump, setting a carried-over amount of fluid by which the set value of the fluid pumping amount exceeds the predetermined fluid pumping amount, the carried-over amount of fluid being carried over to a next setting of the fluid pumping amount; a prediction means for calculating a predicted pressure in the pressure accumulating chamber that occurs before starting a next fluid pumping operation, on a basis of a pressure in the pressure accumulating chamber that occurs before starting a present fluid pumping operation, an amount of fluid ejected from the pressure accumulating chamber, and a fluid pumping amount; a prediction feedback means for setting a prediction feedback amount for the fluid pumping amount on the basis of the target value of pressure and the predicted pressure in the pressure accumulating chamber predicted by the prediction means, in such a manner that the pressure in the pressure accumulating chamber occurring at an ending time of the next fluid pumping operation becomes substantially equal to the target value of pressure; a correction means for correcting the fluid pumping amount to be pumped during the next fluid pumping operation which fluid pumping amount is set by the setting means, by using the prediction feedback amount. The ECU 20 adjusts the amount of fuel pumped from the high-pressure fuel pump 5 to the common rail 3 by controlling an intake regulating valve of the pump 5 as described below, and performs fuel pressure control where the fuel pressure in the common rail 3 is controlled in accordance with the engine load, the engine revolution speed, and the like. The ECU 20 also performs fuel injection control where the amount of fuel injected into each cylinder is controlled by controlling the valve open time of the corresponding fuel injection valve 1.

To perform the aforementioned controls, input ports of the ECU 20 receive various electric signals. For example, an electric signal corresponding to the fuel pressure in the common rail 3 from a fuel pressure sensor 31 provided in the common rail 3 is inputted through another A/D converter 34. A signal corresponding to the amount of operation (depression amount) of an accelerator pedal (not shown) from an accelerator pedal depression sensor 35 provided for the accelerator pedal is inputted to an input port of the ECU 20 through another A/D converter 34.

Furthermore, input ports of the ECU 20 receive two types of signals from a crank angle sensor 37 disposed near an engine crankshaft (not shown): a reference pulse signal that is outputted when the crankshaft reaches a reference angular position (for example, the top dead center of the first cylinder); and an revolution pulse signal that is outputted at intervals of a constant revolution angle of the crankshaft.

The ECU 20 calculates a crankshaft revolution speed from the time interval of revolution pulse signals, and detects a crankshaft revolution angle (phase) CA by counting revolution pulse signals inputted subsequent, to the input of a reference pulse signal.

Output ports of the ECU 20 are connected to the fuel injection valves 1, via a drive circuit 40, for control of the operation of each fuel injection valve 1, and also connected to a solenoid actuator that controls the opening and closing of the intake regulating valve of the high-pressure fuel pump 5, via another drive circuit 40, for control of the pumping amount from the pump 5.

The construction of the high-pressure fuel pump 5 will be described with reference to FIG. 2.

Figure 2:
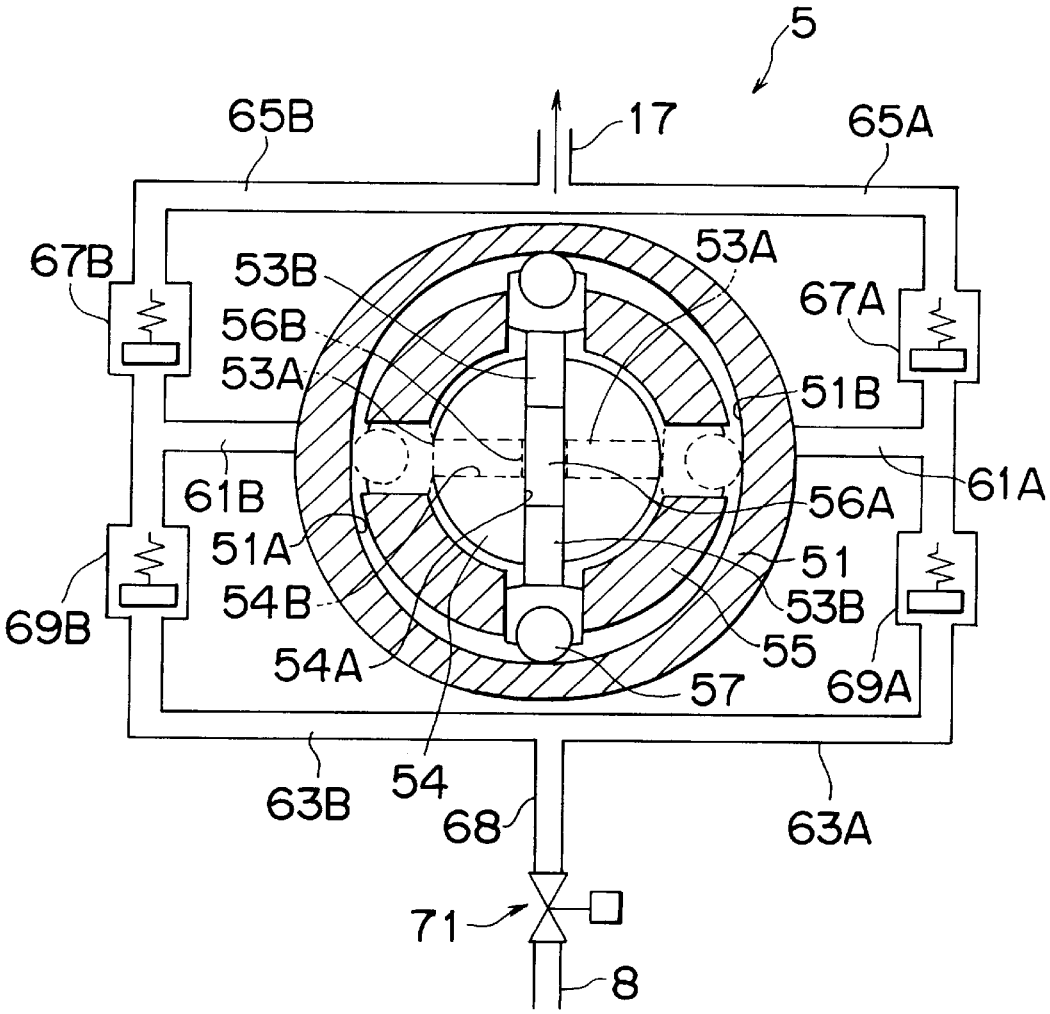
FIG. 2 is a schematic diagram of an intake adjusting-type two-lobe cam plunger fuel pump.

As shown in FIG. 2, an inner cam ring 51 is fixed in a pump housing (not shown). Shoe guides 55 revolve within the inner cam ring 51 by a pump drive shaft (not shown). A cylinder 54A and a cylinder 54B are formed in a cylinder block 54 in directions of its diameter. The cylinders 54A, 54B are arranged in planes perpendicular to the pump drive shaft. The cylinders 54A, 54B extend perpendicular to each other, and they are spaced apart from each other by an appropriate distance in the direction of the axis of the pump drive shaft. Within each of the cylinders 54A, 54B, a pair of plungers 53A or 53B are disposed facing each other.

In this embodiment, the inner cam ring 51 is a two-lobe cam having two cam lobes 51A, 51B.

Each plunger is connected to a cam roller 57 that is in sliding contact with the inner surface of the inner cam ring 51. When the cylinder block 54 rotates, each plunger reciprocates within the cylinder block 54 following a cam profile of the inner cam ring 51. In this embodiment, the two cam lobes 51A, 51B of the inner cam ring 51 are arranged symmetrically about the axis or center of the pump drive shaft. Therefore, as the cylinder block 54 rotates, the pair of plungers 53A within the cylinder 54A and the pair of plungers 53B within the cylinder 54B move in radially opposite directions. That is, when the plungers 53A move radially outward, the plungers 53B move radially inward. Pump chambers 56A, 56B that are defined between the plungers 53A, 53B within the cylinders 54A, 54B, respectively, change in capacity with the reciprocating motion of the plungers, thereby taking in and ejecting fuel.

An intake pressure passage 61A is connected to the pump chamber 56A of the cylinder 54A as shown in FIG. 2. A pressure check valve 67A connects the intake pressure passage 61A and a pressure passage 65A. An intake check valve 69A connects the intake pressure passage 61A and an intake passage 63A. A similar intake pressure passage 61B is provided for the pump chamber 56B of the cylinder 54B. The intake pressure passage 61B is connected to a pressure passage 65B and an intake passage 63B, via a pressure check valve 67B and an intake check valve 69B, respectively. The two pressure passages 65A, 65B meet downstream and connect to the high-pressure pipe 17, which connects to the common rail 3. The two intake passages 63A, 63B meet upstream and connect to a collective intake passage 68.

The collective intake passage 68 is connected to the low-pressure pipe 8 extending from the aforementioned feed pump 9, by an intake regulating valve 71.

The intake regulating valve 71 in this embodiment is an electromagnetic open-close valve having a solenoid actuator. The electromagnetic valve is opened when the solenoid is electrified by the drive circuit 40 controlled by the ECU 20. The valve is closed when the electrification is stopped.

As the plungers in a cylinder approach the cam lobes 51A, 51B along with revolution of the shoe guides 55 of the high-pressure fuel pump 5, the plungers are moved toward the center of the cylinder block 54, following the cam lobes. The capacity of the pump chamber of the cylinder is thus reduced. Therefore, fuel in the pump chamber is pressurized, and pumped out toward the common rail 3, through the intake pressure passage 61A or 61B, the pressure check valve 67A or 67B, and the pressure passage 65A or 65B. As the plungers pass and move away from the summits of the cam lobes 51A, 51B, the pump capacity increases, so that fuel flows into the pump chamber from the collective intake passage 68 through the intake passage 63A or 63B, the intake check valve 69A or 69B, and the intake pressure passage 61A, 61B.

This embodiment employs the two-lobe cam as shown in FIG. 2, so that each plunger pumps out fuel twice in every revolution of the pump. Since the two cylinders 54A, 54B are perpendicular to each other, the pump 5 in this embodiment pumps out fuel four times in every revolution. In this embodiment, the pump 5 is connected to the crankshaft of the engine 10, and operated at half the revolution speed of the crankshaft. Therefore, each of the cylinders 54A, 54B undergoes one stroke cycle of taking in and pumping out fuel for every crankshaft revolution of 360°. That is, the pump 5 pumps out fuel at every crankshaft revolution of 180°.

The pumping amount regulating method according to this embodiment will be described. In this embodiment, the amount of fuel pumped by the pump is controlled by adjusting the amount of fuel drawn into the pump chamber during the intake stroke of each cylinder. When a plunger starts the intake stroke after passing the summits of the cam lobes 51A, 51B, the ECU 20 electrifies the solenoid actuator of the intake regulating valve 71 and holds the intake regulating valve 71 at the open position for a predetermined period following the start of the intake stroke, so that fuel flows into the pump chamber. At the elapse of the predetermined period, the ECU 20 stops electrifying the solenoid actuator to close the intake regulating valve 71, so that the supply of fuel into the pump chamber is discontinued for the rest of the period of the intake stroke. When the pumping stroke starts, the amount of fuel drawn into the pump chamber during the intake stroke is pumped out of the cylinder.

That is, the amount of fuel pumped from the high-pressure fuel pump 5 is determined by the open valve period of the intake regulating valve, i.e., the period of electrification of the solenoid actuator, in this embodiment.

In this embodiment, fuel is pumped out in every crankshaft revolution of 180° by the cylinders 54A, 54B alternately pumping out fuel, that is, each cylinder completes one stroke cycle in every crankshaft revolution of 360°, as described above. Therefore, the amount of fuel set at time point $T_1$ immediately before the fuel injection into the first engine cylinder is pumped toward the common rail 3, not immediately after the fuel injection into the engine cylinder, but after the end of the fuel injection into the next engine cylinder (third cylinder). The engine operating condition changes between the time point of setting the amount of fuel and the time point of actually pumping the amount of fuel during transitional engine operation or the like. Therefore, a problem that the amount thus pumped is inappropriate for the present operating condition may occur.

Measures for solving this problem will be described below in conjunction with first through six embodiments.

The first embodiment of the invention will be described.

Figure 13:
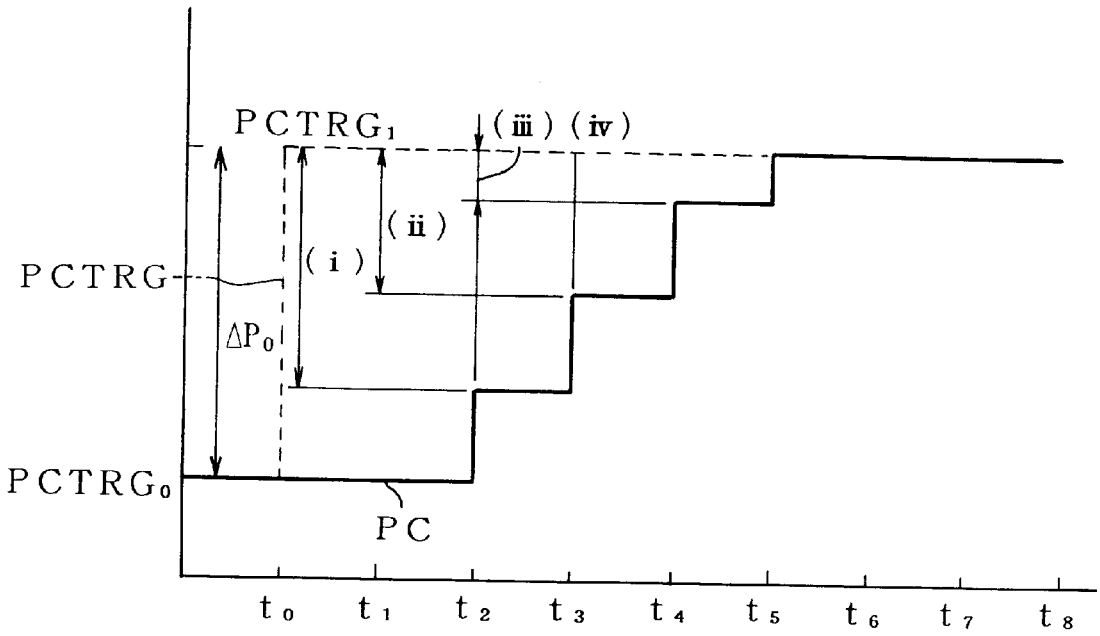
FIG. 13 is a graph illustrating how pressure in a pressure accumulating chamber is changed according to the first embodiment of the invention.
Figure 14:
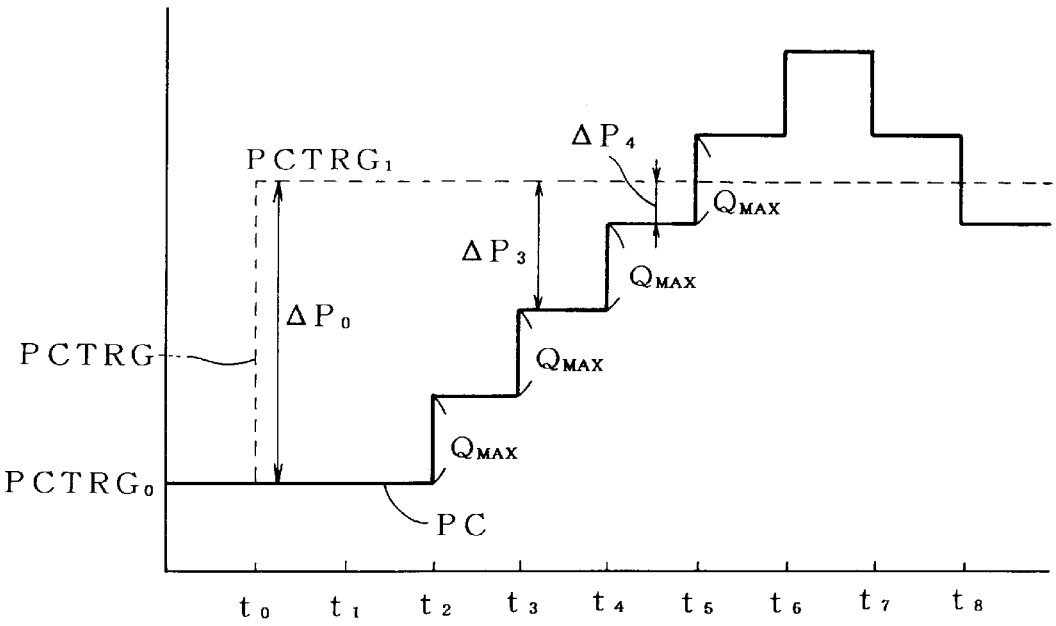
FIG.14 RELATED ART
FIG. 14 is a graph illustrating related technology where an intake adjusting-type two-lobe cam pump is applied to a common rail-type fuel injection apparatus of an internal combustion engine.

The first embodiment calculates an amount of fuel required to increase the common rail pressure from the present level to a changed target pressure at, for example, time point $t_0$ in FIG. 13. The required amount of fuel is supplied to the common rail by one fuel pumping operation or several fuel pumping operations in accordance with a maximum amount of fuel that can be pumped by one operation. The amount of fuel required to increase the common rail pressure from the present level to the changed target pressure is proportional to the difference between the present common rail pressure and the changed target pressure. Assuming that the common rail pressure equals the target pressure before the change, the amount of fuel required for the pressure increase is proportional solely to the amount of change of the target pressure. Therefore, the common rail pressure will become equal to the changed target pressure if the common rail is supplied with the sum of the amount of fuel ejected from the common rail at the time of normal fuel injection, i.e., the basic pumping amount, and the amount of fuel required for the aforementioned pressure increase. If the entire amount of fuel required for the pressure increase cannot be pumped out by one fuel pumping operation of the pump, the entire amount of fuel required can be pumped toward the common rail by a plurality of fuel pumping operations so that the common rail pressure eventually increases to the target pressure. The amount of fuel required for the pressure increase is determined solely by the amount of change of the target pressure, and is not affected by a change in the common rail pressure that occurs after the change of the target pressure. Therefore, the exact amount of fuel required to increase the actual common rail pressure to the target pressure can be eventually supplied to the common rail, even if the common rail pressure changes at every fuel pumping operation. The controllability of the common rail pressure is thereby improved.

Figure 3:
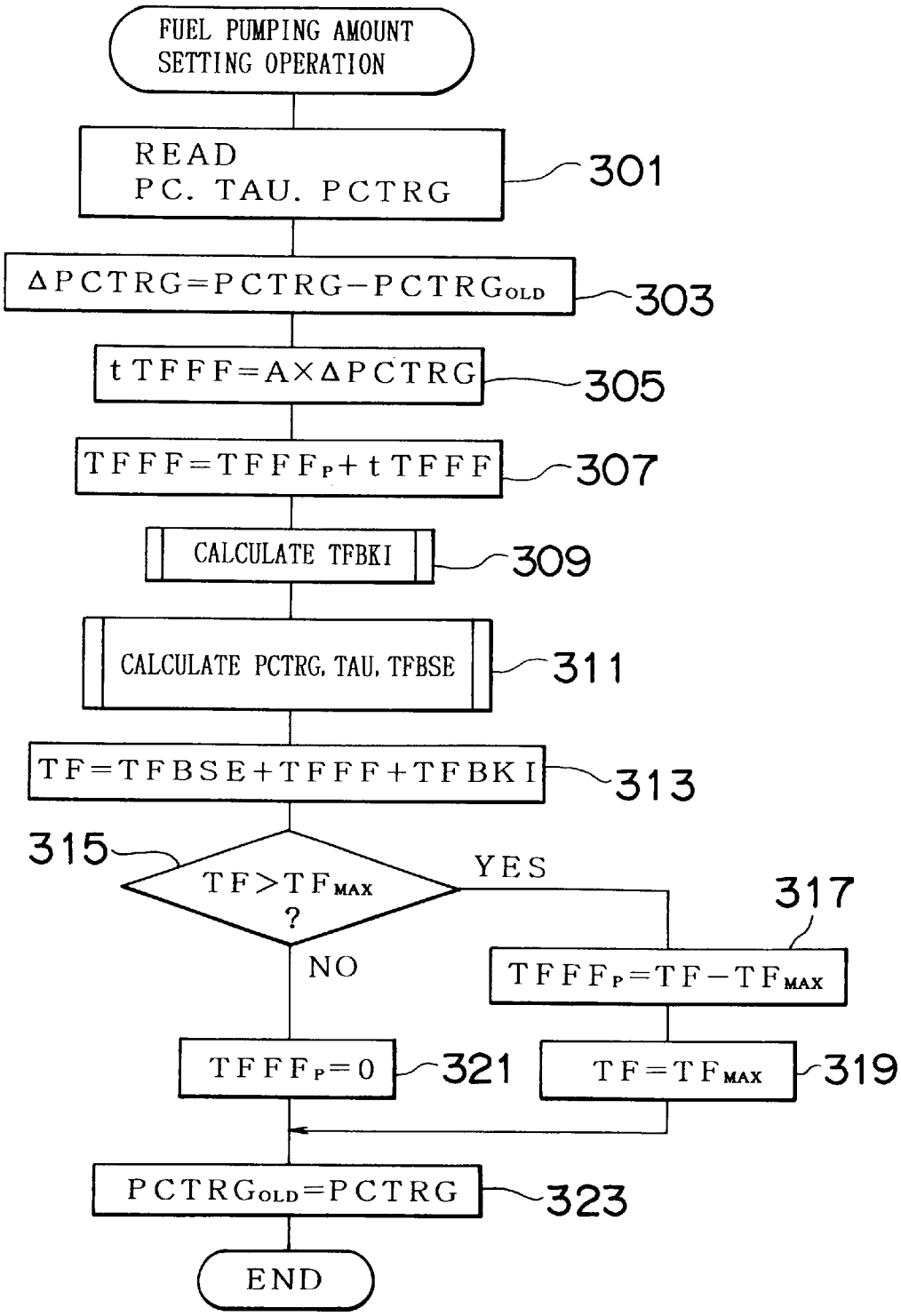
FIG. 3 is a flowchart illustrating an operation of setting a fuel pumping amount to be pumped by the fuel pump according to a first embodiment of the invention.

FIG. 3 shows a flowchart illustrating a pumping fuel amount setting operation in this embodiment. This operation is accomplished by a routine executed by the ECU 20 immediately before the fuel injection into each cylinder, i.e., time points as indicated by $T_1$, $T_2$, $T_3$ in FIG. 12, that is, at every crankshaft revolution of 180°.

When the operation illustrated in FIG. 3 is started, the ECU 20 reads in a common rail fuel pressure PC, the present fuel injection amount instruction value TAU, and a target common rail pressure value PCTRG in step 301. The fuel injection amount instruction value TAU is calculated on the basis of the engine revolution speed and an accelerator opening (accelerator pedal depression amount), by a routine separately executed by the ECU 20 prior to the operation illustrated in FIG. 3. The target common rail pressure value PCTRG is calculated on the basis of the engine revolution speed and the fuel injection amount instruction value TAU.

Subsequently, in step 303, a change ΔPCTRG of the target common rail pressure provided between the previous execution and the present execution of this operation is calculated as:

$$\Delta PCTRG = PCTRG - PCTRG_{OLD}$$

where $PCTRG_{OLD}$ is the target pressure used in the previous execution of the operation.

Subsequently, in step 305, a fuel pumping amount tTFFF required to increase the common rail pressure by the change ΔPCTRG of the common rail pressure is calculated as:

$$tTFFF = A \times \Delta PCTRG$$

The amount of fuel required to increase the common rail pressure by ΔPCTRG is proportional to ΔPCTRG since the capacity of the common rail is constant. Therefore, if the target pressure is increased by ΔPCTRG, it becomes necessary to pump an amount of fuel proportional to ΔPCTRG in order that the common rail pressure will follow the change of the target pressure. In step 305, the required pumping fuel amount tTFFF is calculated as in the aforementioned equation, where A is a positive proportionality factor determined from the common rail capacity and the bulk modulus of fuel.

Subsequently, in step 307, the present total amount of fuel required TFFF is calculated as the sum of the carried-over amount $TFFF_P$ up to the previous execution and the present amount of fuel required tTFFF. The carried-over amount $TFFF_P$ will be described later.

Subsequently, in step 309, the ECU 20 calculates a feedback integration term TFBKI of the pumping fuel amount. In this embodiment, the integration term TFBKI is determined as a value proportional to the value Σ(PCTRG−PC) obtained by accumulating the difference between the target pressure and the actual common rail pressure at every execution of this operation, that is, TFBKI=B×Σ(PCTRG−PC) where B is an integration factor (constant value).

If the required amount of fuel is calculated on the basis of the amount of change of the target pressure with high precision, the common rail pressure can be precisely controlled to the changed target pressure on the basis of only the calculated required amount of fuel. However, despite high precision in calculation of the required amount of fuel, variations in characteristics that occur in an actual construction due to tolerances regarding the fuel pump, the intake regulating valve and the like may result in a slight error between the common rail pressure and the target pressure. Therefore, in addition to the control based on the amount of change of the target pressure, this embodiment employs the feedback integration term TFBKI for precise control.

In step 311, a basic fuel pumping amount TFBSE is calculated. A basic fuel pumping amount TFBSE corresponds to an amount of fuel pumped out when the engine is in a steady operating condition and the fuel injection amount and the target common rail pressure value are constant. The basic fuel pumping amount TFBSE is determined by the fuel injection amount TAU and the target common rail pressure value PCTRG. In this embodiment, the basic fuel pumping amount TFBSE is pre-stored in a ROM of the ECU 20 in the form of a numerical table using the fuel injection amount TAU and the target common rail pressure value PCTRG.

Subsequently, in step 313, the ECU 20 calculates a final set value of fuel pumping amount TF as:

$$TF = TFBSE + TFFF + TFBKI$$

That is, the set value of fuel pumping amount TF is calculated as the sum of the fuel pumping amount TFBSE in the steady condition, an amount of fuel TFFF required to cause the common rail pressure to follow the change of the target pressure in the transitional condition, and the compensating amount TFBKI for the variations in characteristics of various factors.

The value TF actually represents the opening timing (crank angle) of the intake regulating valve 71. As the value TF increases, the fuel pumping amount increases.

Subsequently, in step 315, it is determined whether the pumping amount TF set as described above exceeds the maximum fuel pumping amount TFMAX of the pump 5. In this embodiment, the value TFMAX is a crank angle corresponding to the end of the intake stroke of the plungers of the pump 5. However, this is merely illustrative. The value TFMAX may also be a value corresponding to a predetermined crank angle.

If it is determined in step 315 that TF>TFMAX, it means that the entire amount of fuel presently required cannot be supplied by the present pumping stroke. The amount of fuel TF—TFMAX that cannot be supplied by the present pumping stroke is carried over to the next and later fuel pumping strokes (step 317). In step 319, the maximum amount TFMAX of fuel is pumped out by the present pumping stroke. That is, if the change of the target common rail pressure value PCTRG is sharp so that the required amount of fuel cannot be supplied by one fuel pumping stroke, the required amount of fuel is supplied by a plurality of fuel pumping strokes to eventually supply the exact amount of fuel required. Conversely, if it is determined TF≦TFMAX in step 315, a carried-over amount of fuel $TFFF_P$ is set to 0 in step 321. In step 323, the value $PCTRG_{OLD}$ is updated to prepare for the next execution of the operation. Subsequently, the present execution ends.

When the fuel pumping amount TF is set by the operation described above, the intake regulating valve 71 of the pump 5 is opened while the crankshaft rotates an angle corresponding to the value TF from the angle position corresponding to the start of the plunger intake stroke, so that the set amount of fuel is drawn into the corresponding cylinder of the pump 5.

This embodiment eventually supplies the common rail with the exact amount of fuel required to change the actual common rail pressure following a change of the target common rail pressure. Therefore, the controllability of the common rail pressure considerably improves.

The second embodiment of the invention will be described below with reference to FIG. 4. This embodiment's operation is performed at the same timing as in the first embodiment.

The second embodiment calculates a total required amount of fuel TFFF in the same manner as in the first embodiment, but does not reflect the total amount TFFF in the present fuel pumping amount if the value TFFF is less than a predetermined value C. The amount TFFF increases as the change of the target common rail pressure value PCTRG increases. Therefore, the amount TFFF takes smaller values as the change in the operating condition decreases and the condition approaches the steady condition. The target common rail pressure value PCTRG is calculated on the basis of the engine revolution speed and the fuel injection amount instruction value TAU, as stated above. Therefore, there can be a case where the target common rail pressure value PCTRG fluctuates with small fluctuation of the engine revolution speed even during steady operation. If the total required amount of fuel TFFF is calculated every time the target common rail pressure value PCTRG slightly changes, the fluctuation of the common rail fuel pressure PC may become significant so as to cause hunting. Therefore, this embodiment refrains from reflecting the total required amount of fuel TFFF in the actual fuel pumping amount to prevent hunting, if the value TFFF decreases to or below the predetermined value.

If the embodiment stops reflecting the total required amount of fuel TFFF in the fuel pumping amount, the embodiment performs feedback proportional control based on the deviation of the actual common rail fuel pressure PC from the target pressure PCTRG, so as to accelerate convergence of the common rail pressure to the target value. The feedback proportional control is performed only when the TFFF control based on the change of the target pressure PCTRG is stopped, because simultaneous performance of the TFFF control and the feedback proportional control may result in interference with each other so that the common rail pressure fluctuation may be amplified.

Although the foregoing embodiment performs the feedback proportional control when the TFFF control is stopped, the feedback proportional control is not necessarily performed when the TFFF control is stopped. It is also possible to merely perform the control based only on the basic fuel pumping amount TFBSE and the feedback integration term TFBKI as in normal operation.

Figure 4:
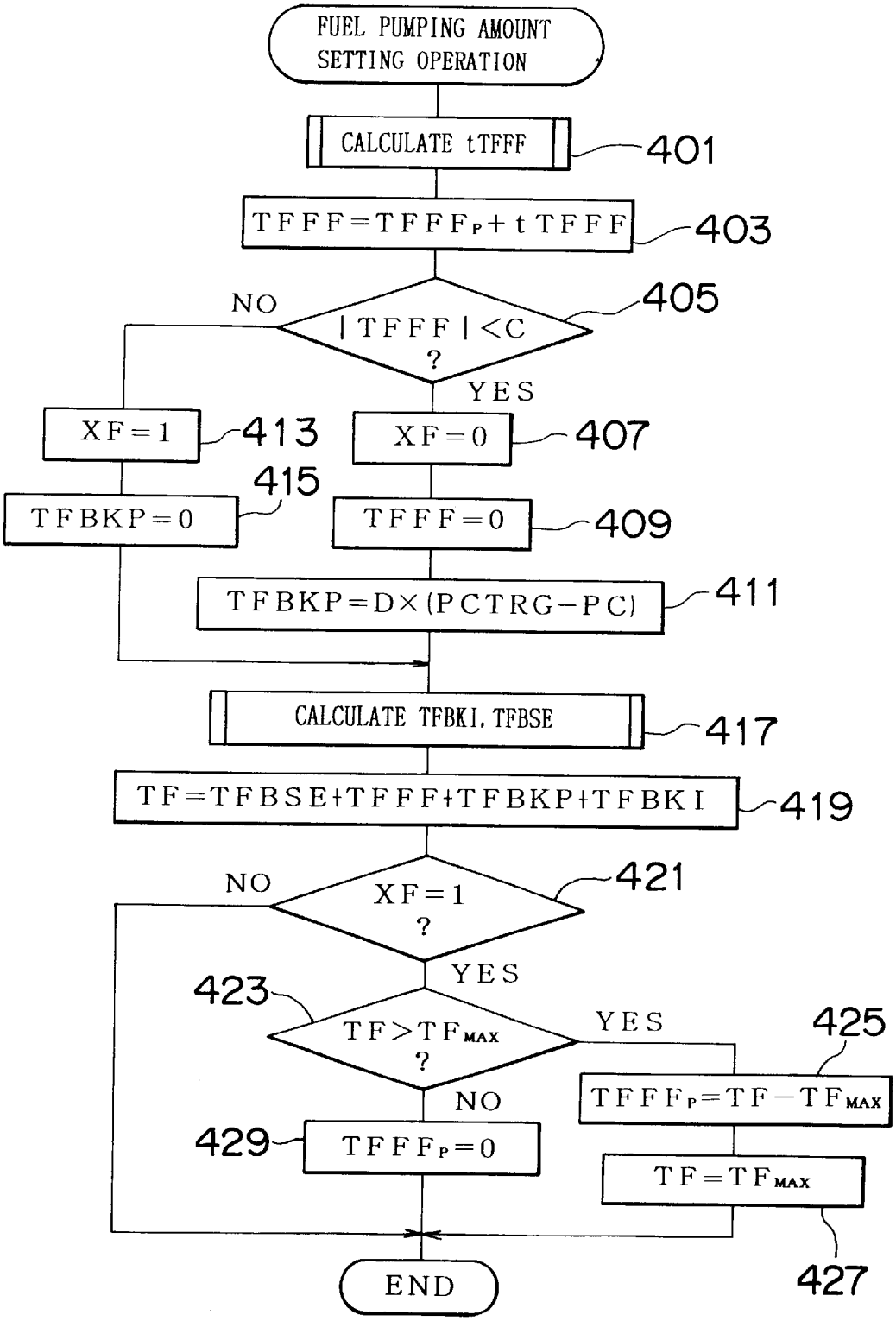
FIG. 4 is a flowchart illustrating an operation of setting the fuel pumping amount to be pumped by the fuel pump according to a second embodiment of the invention.

In steps 401,403 in FIG. 4, a total required amount of fuel TFFF is calculated in the same manner as in steps 301 through 307 in FIG. 3.

After calculating the amount TFFF, this embodiment determines in step 405 whether the absolute value of the amount TFFF is less than the predetermined value C. If |TFFF|≧C, the ECU 20 sets a flag XF to 1 in step 413, and a feedback proportional term TFBKP (described later) to 0 in step 415. The flag XF indicates whether the amount TFFF is to be reflected in the fuel pumping amount, that is, whether the TFFF control is to be performed, where XF=1 indicates that the TFFF control is to be performed. In this case, since the feedback proportional term TFBKP is set to 0 in step 415, the feedback proportional control is not performed.

If it is determined in step 405 that |TFFF|<C, the ECU 20 sets the flag XF to 0 (the TFFF control is stopped) in step 407, and sets the value TFFF to 0 in step 409. Subsequently, in step 411, the feedback proportional term TFBKP is calculated as a value proportional to the deviation of the actual common rail fuel pressure PC from the target pressure PCTRG, that is, TFBKP=D×(PCTRG−PC) where D is a positive proportional factor).

The constant C used in step 405 is a lower limit value of the total required amount of fuel TFFF that can cause hunting during the TFFF control. The precise value of the constant C is set based on experiments.

After setting the values TFFF and TFBKP, the ECU 20 calculates, in step 417, the feedback integration term TFBKI and the basic fuel pumping amount TFBSE in the same manner as m steps 309, 311 in FIG. 3. Subsequently, in step 419, the final set value of fuel pumping amount TF is set as TF=TFBSE+TFFF+TFBKP+TFBKI.

In steps 421 through 429, the carried-over fuel pumping amount $TFFF_P$ is calculated only if the TFFF control is being performed (XF=1).

This embodiment stops the TFFF control based on the amount of change of the target pressure if the value TFFF is small, as described above. Therefore, the embodiment can prevent the hunting of the common rail pressure and converge the common rail pressure precisely to the target pressure.

The third embodiment of the invention will be described below.

As in the second embodiment, the third embodiment stops the TFFF control and performs the feedback proportional control if the value TFFF becomes small. This embodiment differs from the second embodiment in that the feedback proportional control is also performed during the TFFF control. The second embodiment switches the control mode between the TFFF control and the feedback proportional control at the time of |TFFF|=C. Although |TFFF|=C is a state corresponding to the transition from the engine transitional operation to steady operation, abrupt switching from the TFFF control to the feedback proportional control in response to the establishment of |TFFF|=C may degrade the pressure controllability.

On the other hand, simultaneous performance of the TFFF control and the feedback proportional control may amplify the pressure fluctuation due to the interference between the two controls as stated above.

Therefore, if |TFFF|≧C, the third embodiment performs the feedback proportional control together with the TFFF control, with the feedback gain D set to a value that is smaller than that used when the TFFF control is stopped. This setting reduces the influence of the feedback proportional term TFBKP on the set value of fuel pumping amount TF while the TFFF control is being performed, so that the effect of the feedback proportional control decreases. Therefore, the interference between the feedback proportional control and the TFFF control is prevented.

Figure 5:
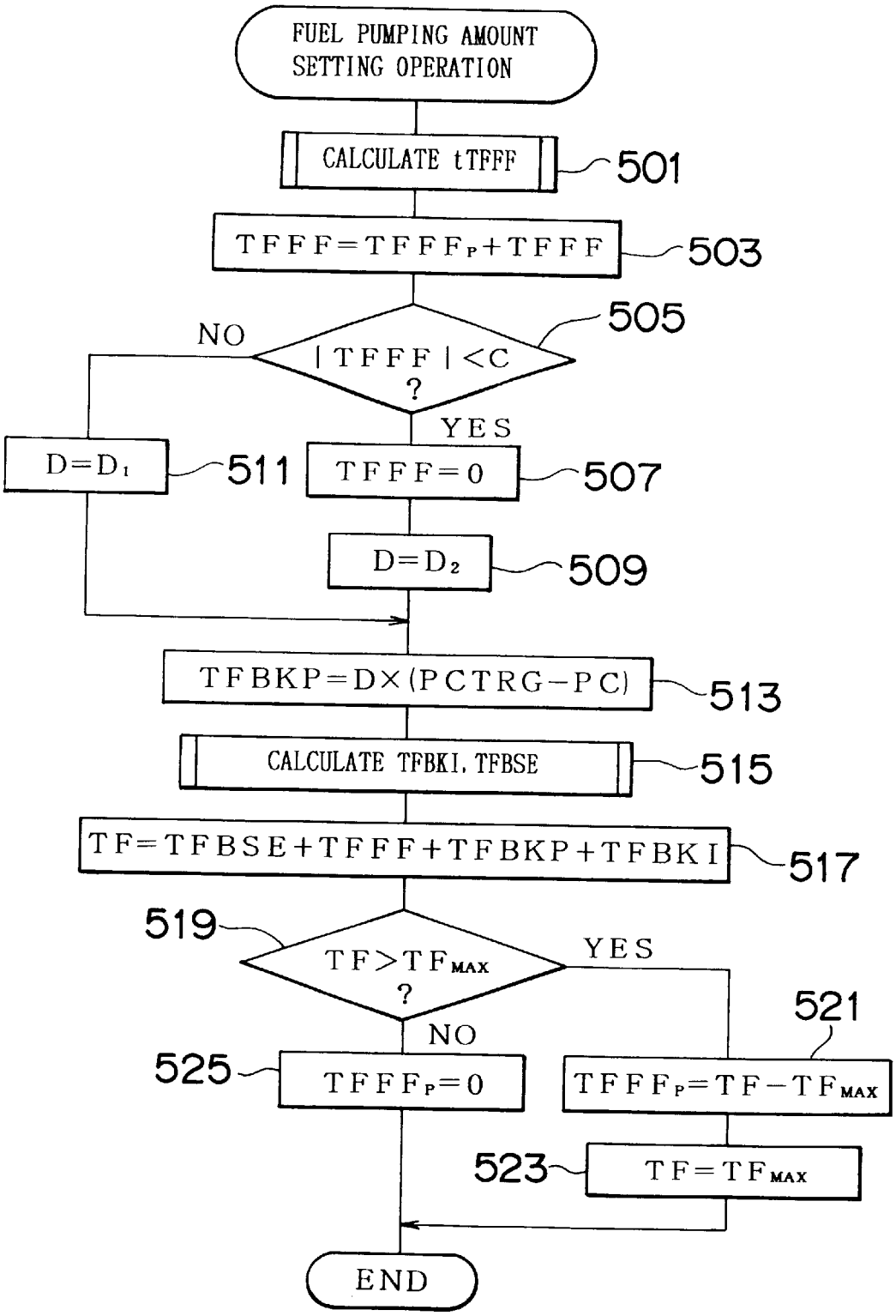
FIG. 5 is a flowchart illustrating an operation of setting the fuel pumping amount to be pumped by the fuel pump according to a third embodiment of the invention.

FIG. 5 shows a flowchart illustrating a fuel pumping amount setting operation according to this embodiment. This operation is performed by the ECU 20 at the same timing as in the embodiments illustrated in FIGS. 3 and 4.

In steps 501, 503 in FIG. 5, a total required amount of fuel TFFF is calculated on the basis of the amount of change of the target pressure in the same manner as in steps 301 through 307 in FIG. 3 and steps 401, 403 in FIG. 4.

Subsequently, in step 505, the ECU 20 determines whether the value |TFFF| is less than the constant C, as in the operation illustrated in FIG. 4. If |TFFF|<C, the ECU 20 sets the value TFFF to 0 in step 507, to stop the TFFF control. Subsequently, in step 509, the gain D of the feedback proportional term is set to a constant value $D_2$. Conversely, if it is determined in step 505 that |TFFF|≧C, the ECU 20 does not change the value TFFF but performs the TFFF control, and sets the gain D of the feedback proportional term to $D_1$ in step 511, where $D_1$ is a positive value smaller than $D_2$, i.e., $0<D_1<D_2$.

In step 513, the ECU 20 calculates the feedback proportional term TFBKP by using the thus-set gain D. Through this operation, the value of the feedback proportional term is set smaller in a case where the TFFF control is being performed than in a case where the TFFF control is stopped, even if the difference between the actual common rail pressure and the target pressure remains unchanged in the two cases. Therefore, the interference between the TFFF control and the feedback proportional control is prevented.

In steps 519 through 523, the ECU 20 performs the same calculating operation as in steps 315 through 319 in FIG. 3.

In this manner, this embodiment is able to prevent deterioration of the common rail pressure controllability due to the switching between the TFFF control and the feedback proportional control, and to hold the common rail pressure precisely at the target pressure.

The fourth embodiment of the invention will be described below.

This embodiment does not perform the TFFF control based on the amount of change of the target pressure as performed in the first to third embodiments, but sets a fuel pumping amount by using only the basic fuel pumping amount TFBSE, the feedback integration term TFBKI, and the feedback proportional term TFBKP.

This embodiment predicts a common rail pressure PRPC occurring at the timing of performing the next fuel pumping amount setting operation (time point $T_2$ in FIG. 12), and uses the predicted common rail pressure PRPC, instead of the actual common rail pressure PC, to calculate a feedback proportional term TFBKP.

Figure 12:
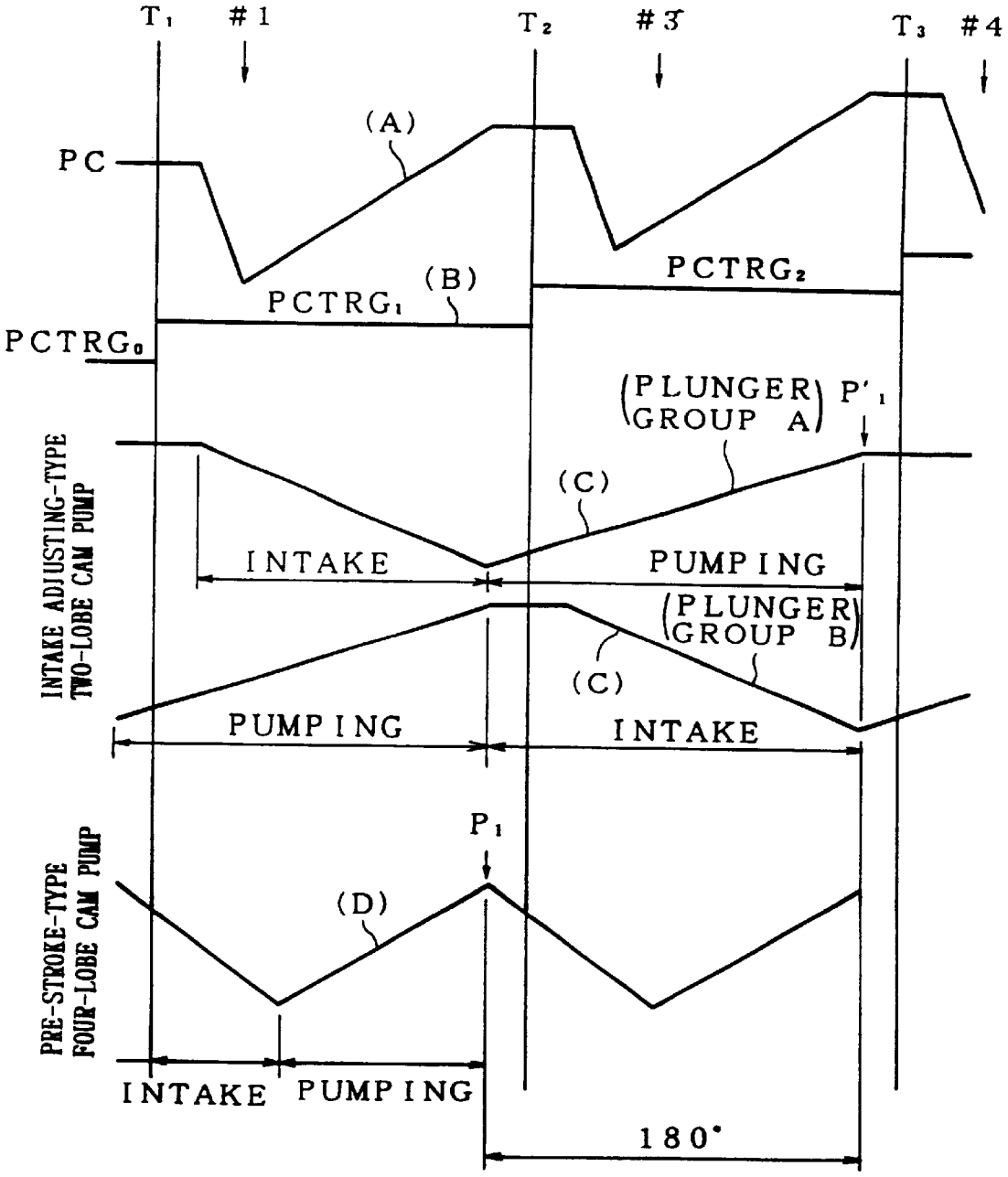
FIG. 12 RELATED ART
FIG. 12 is a graph illustrating the common rail pressure control where an intake adjusting-type two-lobe cam pump is applied to a common rail-type fuel injection apparatus of an internal combustion engine.

As indicated in FIG. 12, the amount of fuel set on the basis of the target pressure and the common rail pressure at time point $T_1$ is supplied to the common rail at time point $P'T_1$ in the intake adjusting-type two-lobe cam pump. Therefore, if the difference between the target pressure and the actual pressure is large at time point $T_1$, the amount of fuel supplied to the common rail at time point $P'_1$ becomes large. If the amount of fuel pumped toward the common rail after time point $T_1$ (the amount of fuel pumped out after the fuel injection into the first engine cylinder) is sufficiently large, the common rail pressure increases in response to the pumping operation, so that the difference between the target pressure and the actual pressure at time point $T_2$ becomes small. In this case, even though the difference between the target pressure and the common rail pressure at time point $T_2$ is small, the large amount of fuel set at time point $T_1$ is supplied to the common rail at time point $P'_1$, so that the common rail pressure may increase beyond the target pressure, thus resulting in overshoot. Conversely, if the difference between the target pressure and the common rail pressure at time point $T_1$ is small, the difference between the target pressure and the common rail pressure at time point $T_2$ may become large provided that the amount of fuel pumped toward the common rail after time point $T_1$ is small. In this case, the supply of the amount of fuel set at time point $T_1$ to the common rail results in insufficient fuel supply, so that the common rail pressure fails to reach the target pressure, that is, undershoot occurs.

Therefore, when setting a fuel pumping amount at time point $T_1$, this embodiment predicts the common rail pressure PRPC at time point $T_2$, and uses the predicted PRPC and the target pressure to calculated a feedback proportional term TFBKP.

A method for calculating a predicted common rail pressure value PRPC will be described below.

Figure 6:
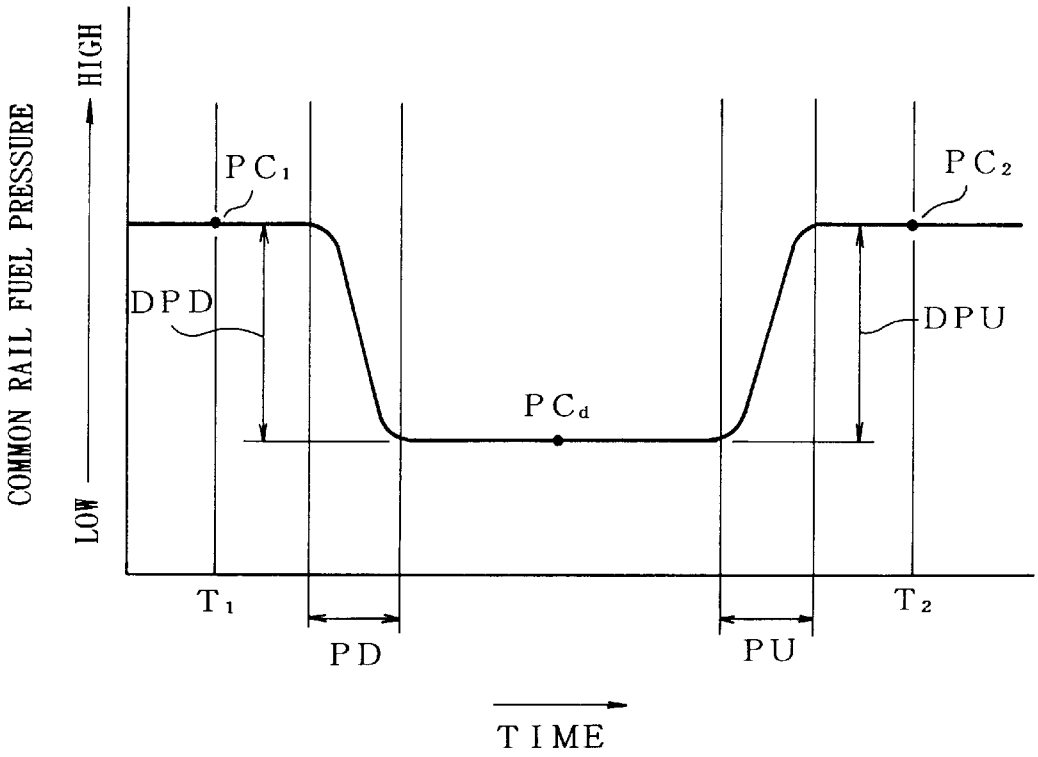
FIG. 6 is a graph illustrating a fuel pumping amount setting method according to a fourth embodiment of the invention.

FIG. 6 is a graph illustrating changes in the common rail pressure PC between time points $T_1$ and $T_2$ indicated in FIG. 12. In FIG. 6, PD indicates the period of common rail pressure decrease caused by the fuel injection into the first engine cylinder, and PU indicates the period of common rail pressure increase caused by the plunger group B after the fuel injection into the first engine cylinder. The common rail pressure, remaining at $PC_1$ after time point $T_1$, decreases by DPD to PCd during the period PD of fuel injection. After that, the common rail pressure increases by DPU during the pumping period PU, and reaches $PC_2$ at time point $T_2$. The common rail pressure decrease DPD caused by the fuel injection and the common rail pressure increase DPU caused by the fuel pumping operation can be expressed as:

$$DPD=(Kv/VPC)\times TAU\times E$$

$$DPU=(Kv/VPC)\times TF\times F$$

where Kv is the bulk modulus of fuel; VPC is the inner capacity of the common rail 3; TAU is the amount of fuel injected during the fuel injection period PD (that is, the amount of fuel injected into the first cylinder); TF is the amount of fuel pumped to the common rail 3 during the fuel pumping period PU (that is, the amount of fuel pumped by the plunger group B); and E, F are conversion factors for converting TAU, TF into actual volumes.

Using DPD, DPU and the common rail pressure $PC_1$ occurring at time point of $T_1$, the common rail pressure occurring at time point $T_2$ can be expressed as:

$$PC_2=PC_1-DPD+DPU$$

At time point $T_1$, the fuel injection amount instruction value TAU for the period PD and the set value of fuel pumping amount TF for the period PU have been calculated. The inner capacity VPC of the common rail 3 and the bulk modulus Kv of fuel are known. Therefore, if the actual fuel injection amount and the actual fuel pumping amount equal the fuel injection amount instruction value TAU and the set value of fuel pumping amount TF, respectively, it is possible to calculate DPD and DPU at time point $T_1$.

In this embodiment, at time point $T_1$, DPD and DPU are calculated in the manner described above, and a predicted value PRPC of the common rail pressure $PC_2$ at time $T_2$ is calculated by using the following equation:

$$PRPC=PC_1-(Kv/VPC)\times(TAU\times E-TF\times F)$$

Using the predicted common rail pressure PRPC calculated as described above, a feedback proportional term TFBKP is calculated, so that the common rail pressure can be precisely controlled to the target pressure.

Figure 7:
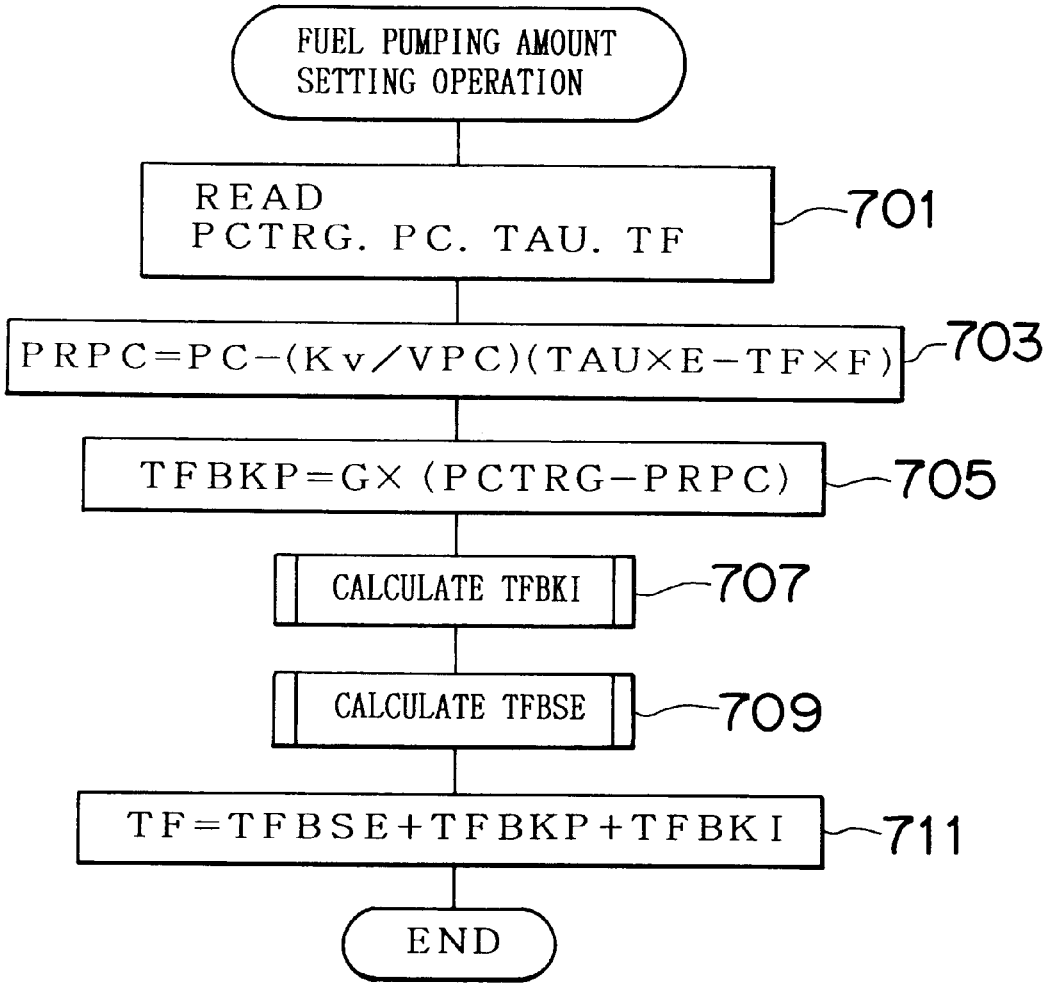
FIG. 7 is a flowchart illustrating an operation of setting the fuel pumping amount to be pumped by the fuel pump according to the fourth embodiment of the invention.

FIG. 7 is a flowchart illustrating a fuel pumping amount setting operation according to this embodiment. This operation is performed through a routine executed by the ECU 20 immediately before fuel injection into the cylinders (time points indicated by $T_1$, $T_2$, $T_3$ in FIG. 12, that is, every crankshaft revolution of 180°).

In step 701 in FIG. 7, the ECU 20 reads in the present common rail fuel pressure PC and the present target pressure PCTRG, and the fuel injection amount instruction value TAU and the set value of fuel pumping amount TF that have been separately calculated by the ECU 20.

Subsequently, in step 703, using the TAU and TF, the ECU 20 calculates a predicted common rail pressure PRPC at a crank angle that is 180° from the present angle, as:

$$PRPC=PC-(Kv/VPC)\times(TAU\times E-TF\times F)$$

Subsequently, in step 705, using the predicted pressure PRPC and the target pressure PCTRG read in step 701, the ECU 20 calculates a feedback proportional term TFBKP as:

$$TFBKP=G\times(PCTRG-PRPC)$$

where G is a positive proportionality factor (gain).

Subsequently, the ECU 20 calculates the feedback integration term TFBKI in step 707, and calculates a basic fuel pumping amount TFBSE in the same manners as in the foregoing embodiments. In step 711, the ECU 20 calculate a set value of fuel pumping amount TF as the sum of TFBSE, TFBKP and TFBKI, that is:

$$TF=TFBSE+TFBKP+TFBKI$$

The fifth embodiment of the invention will be described below.

This embodiment performs the feedback proportional control based on the predicted common rail pressure PRPC as in the fourth embodiment. The fifth embodiment differs from the fourth embodiment in that if the deviation of the present common rail pressure PC from the target pressure PCTRG is less than a predetermined value, the fifth embodiment does not use the predicted pressure PRPC, but uses the actual common rail pressure PC to perform similar feedback proportional control.

The predicted common rail pressure value PRPC is calculated on the basis of the fuel injection amount instruction value TAU and the set value of fuel pumping amount TF as described above. However, due to variations in characteristics resulting from the tolerances regarding the fuel injection valves and the fuel pump, the actual fuel injection amount and the actual fuel pumping amount may be slightly different from TAU and TF, respectively. If so, the predicted common rail pressure value PRPC contains a certain prediction error. Therefore, if the feedback control is performed by using only the predicted value PRPC, the actual common rail pressure may be controlled to a value deviating from the target pressure PCTRG by the aforementioned prediction error. To eliminate this deviation, this embodiment stops the feedback proportional control based on the predicted pressure and switches to the control based on the actual common rail pressure, when the actual common rail pressure comes sufficiently close to the target pressure, more specifically, within the prediction error from the target pressure. Through this operation, the common rail pressure is controlled to precisely to the target pressure.

Figure 8:
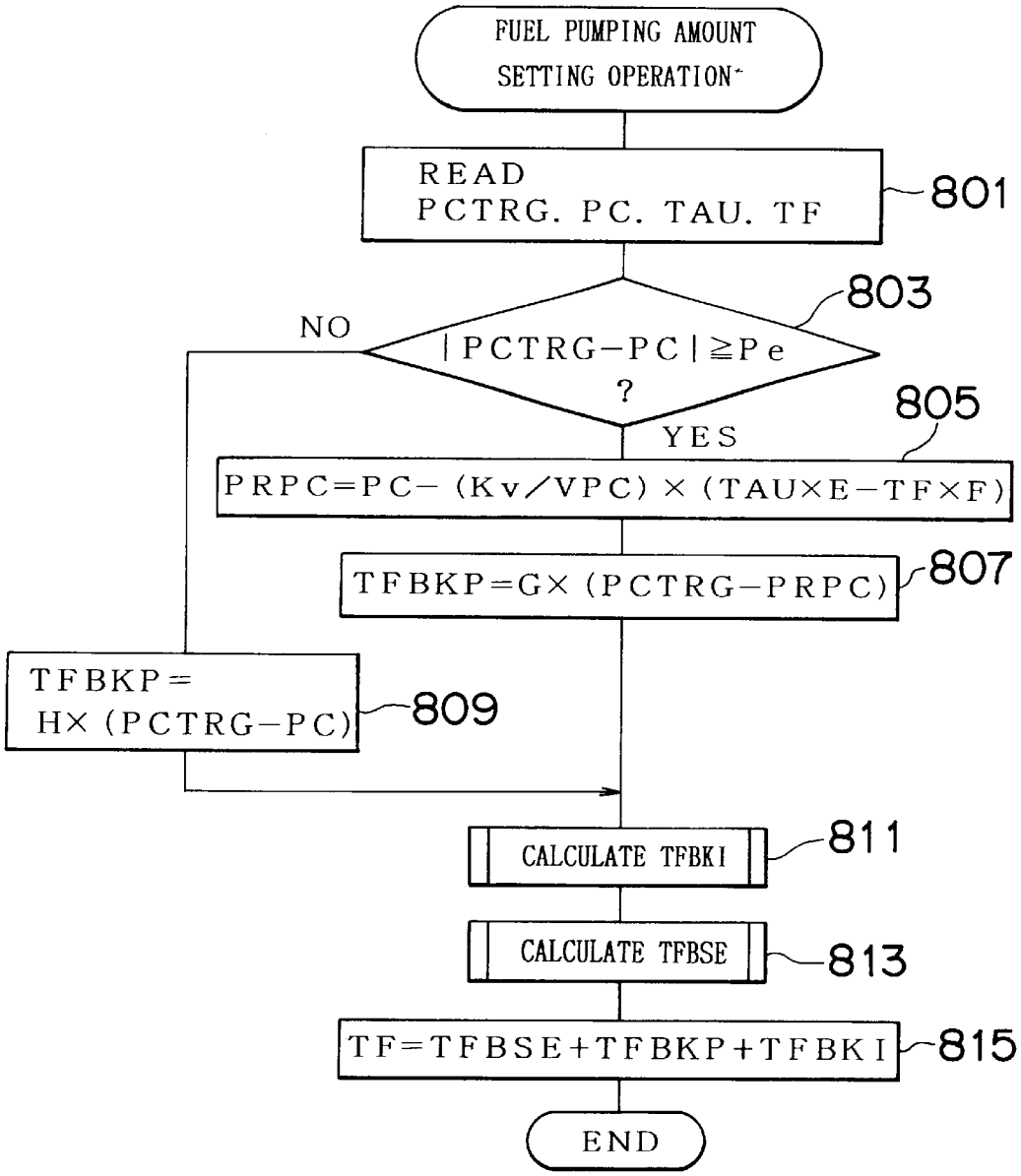
FIGS. 8 through 10 are flowcharts illustrating an operation of setting the fuel pumping amount to be pumped by the fuel pump according to a fifth embodiment of the invention.

FIG. 8 shows a flowchart illustrating a fuel pumping amount setting operation according to this embodiment. This operation is performed by the ECU 20 at the same timing as in the operation illustrated in FIG. 7.

In step 801 in FIG. 8, the ECU 20 reads in PCTRG, PC, TAU, TF as in step 701 in FIG. 7.

Subsequently, in step 803, the ECU 20 determines whether the absolute value |PCTRG−PC| of the difference between the target pressure PCTRG and the actual common rail pressure PC read in step 801 is equal to or greater than a predetermined positive value Pe. The value Pe corresponds to the prediction error contained in the predicted common rail pressure PRPC, and a precise value thereof is determined by experiments.

If it is determined in step 803 that $|PCTRG-PC|\geqq Pe$, the ECU 20 calculates a predicted value PRPC, and calculates a feedback proportional term TFBKP from the predicted value PRPC, in the same manners as in steps 703, 705 in FIG. 7.

Conversely, if it is determined in step 803 that $|PCTRG-PC|<Pe$, operation proceeds to step 809, where a value of the feedback proportional term TFBKP is calculated from the actual common rail pressure PC by using the equation $TFBKP=H\times(PCTRG-PC)$, in order to avoid the effect of the prediction error on the pressure control. The proportionality factor (gain) H used in step 809 is set smaller than the gain G used in step 807, i.e., $0<H<G$. The processing in step 809 is performed because the actual common rail pressure PC is close to the target pressure PCTRG. Since the gain of the feedback proportional term TFBKP used in step 809 is a reduced value, the actual common rail pressure can be favorably converged to the target pressure.

After setting the feedback proportional term TFBKP through as described above, the ECU 20 calculates the feedback integration term TFBKI and the basic fuel pumping amount TFBSE in steps 811, 813, and calculates a set value of fuel pumping amount TF as the sum of TFBKI and TFB SE in step 815, in manners similar to those in steps 707 through 711 in FIG. 7.

The sixth embodiment of the invention will be described below. The first and third embodiments solely perform the control using the total required amount of fuel TFFF based on the amount of change of the target pressure PCTRG. The fourth and fifth embodiments solely perform the feedback proportional control based on the predicted value PRPC of the common rail pressure. In contrast, the sixth embodiment use both the TFFF control as in the second embodiment and the feedback proportional control based on the predicted common rail pressure value as in the fourth embodiment, so as to control the common rail pressure precisely to the target pressure with further improved responsiveness.

Figure 9:
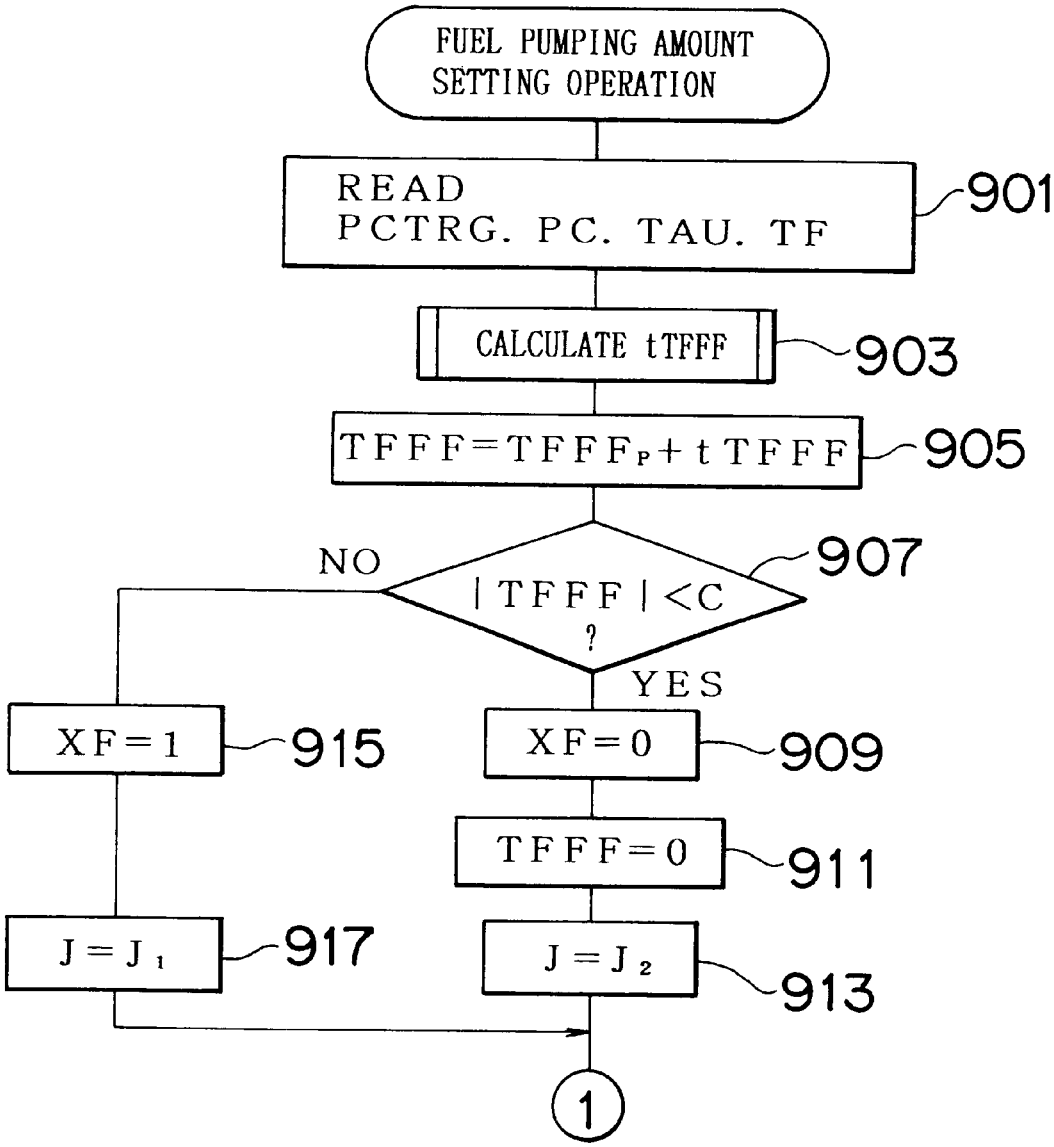
Figure 10:
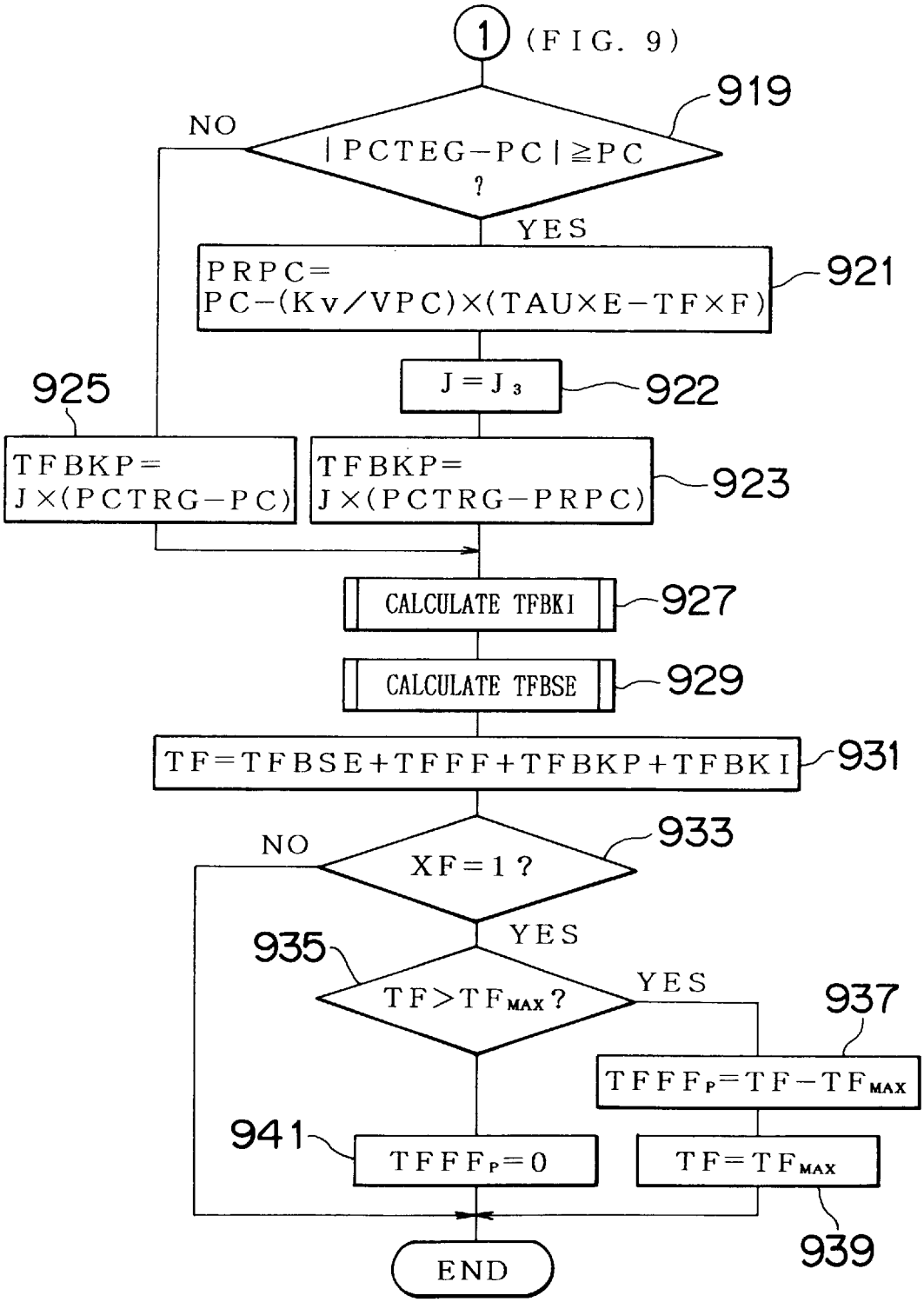
Figure 11:
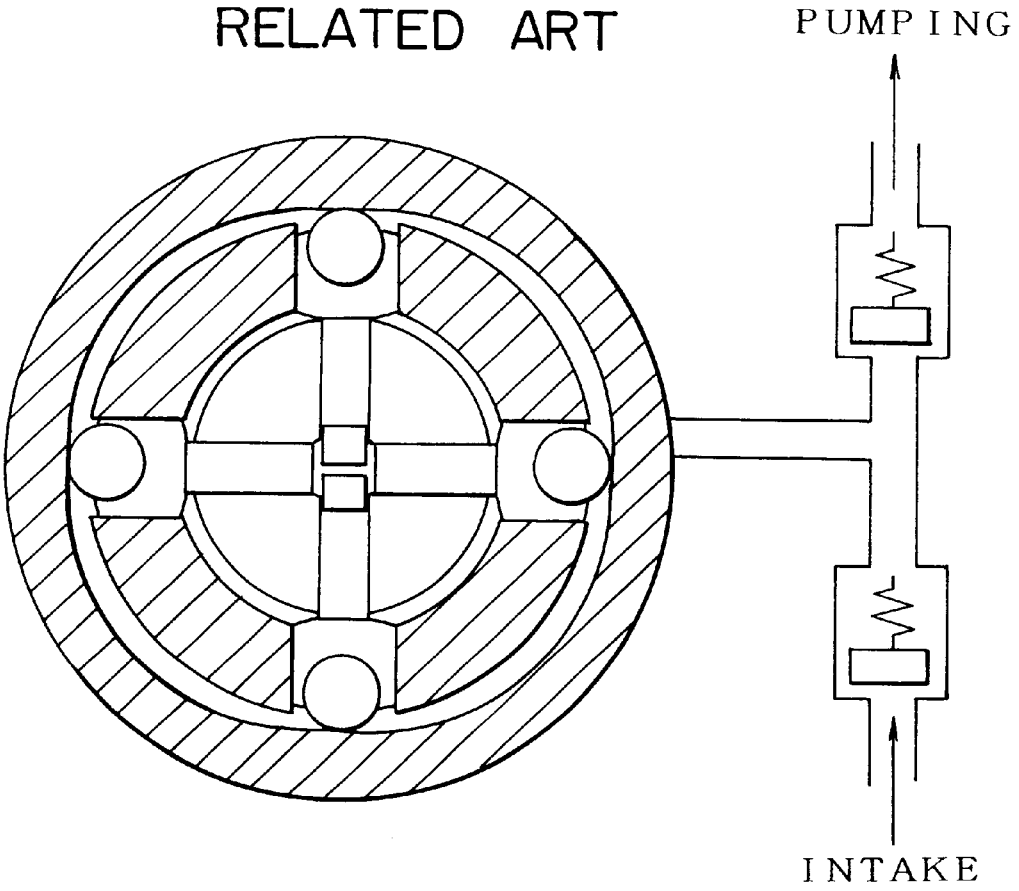
FIG. 11 RELATED ART
FIG. 11 is a diagrammatic view of a conventional four-lobe cam plunger pump.

FIGS. 9 and 10 show a flowchart illustrating a fuel pumping amount setting operation according to this embodiment.

This operation is performed through a routine executed by the ECU 20 immediately before fuel injection into the cylinders (time points indicated by $T_1$, $T_2$, $T_3$ in FIG. 12, that is, every crankshaft revolution of 180°). In FIGS. 9 and 10, the operations in steps 901,903,933–941 correspond to the control using the total required amount of fuel TFFF based on the amount of change of the target pressure PCTRG, and the operations in steps 919–925 correspond to the feedback proportional control based on the predicted common rail pressure value PRPC.

The flowchart of FIGS. 9 and 10 will be briefly described. In step 901 in FIG. 9, the ECU 20 reads in the target common rail pressure value PCTRG, the actual common rail pressure PC, the fuel injection amount instruction value TAU and the set value of fuel pumping amount TF. In steps 903, 905, the ECU 20 calculates a total required amount of fuel TFFF from PCTRG by using $PCTRG_{OLD}$ and $TFFF_P$ in the same manners as in steps 303–307 in FIG. 3.

If the value |TFFF| is less than the predetermined value C in step 907, the ECU 20 sets the flag XF to 0 in step 909, and resets the total required amount of fuel TFFF to 0 to stop the control based on the value TFFF in step 911, and sets the gain J of the feedback proportional term TFBKP to $J_2$ in step 913. Conversely, if the value |TFFF| is equal to or greater than the predetermined value C in step 907, the ECU 20 sets the flag XF to 1 in step 915, to perform the control based on the value TFFF calculated in step 905. In step 917, the ECU 20 sets the gain J of the feedback proportional term TFBKP to $J_1$. In this case, both the TFFF control and the feedback TFBKP control are performed. In order to prevent the interference between the two controls, the gain $J_1$ is set smaller than $J_2$, i.e., $0<J_1<J_2$.

Subsequently, in steps 919–925 in FIG. 10, the ECU 20 performs operations similar to those in steps 803–809 in FIG. 8. That is, if the deviation of the present common rail pressure PC from the target pressure PCTRG is equal to or greater than the predetermined value Pe, the ECU 20 sets the gain J to $J_3$, i.e., $0<J_3<J_2$, in step 922, and sets a feedback proportional term TFBKP based on the predicted common rail pressure value PRPC in steps 921, 923. If the deviation of the actual common rail pressure is less than the predetermined value Pe, the ECU 20 calculates a feedback proportional term TFBKP based on the actual common rail pressure PC in step 925.

In steps 927, 929, the ECU 20 calculates a feedback integration term TFBKI and a basic fuel pumping amount TFBSE as in steps 811, 813 in FIG. 8. In step 931, the ECU 20 calculates a set value of fuel pumping amount TF as:

$$TF=TFBSE+TFFF+TFBKP+TFBKI$$

In steps 933–941, the ECU 20 calculates a carried-over amount of fuel $TFFF_P$ only if the value of the flag XF is 1 (that is, only if the TFFF control is performed) as in steps 421–427 in FIG. 4.

By performing both the control using the total required amount of fuel TFFF based on the amount of change of the target pressure and the feedback proportional control based on the predicted common rail pressure value as described above, this embodiment further improves the controllability of the common rail pressure.

While the present invention has been described with reference to what are presently considered to be preferred embodiments thereof, it is to be understood that the invention is not limited to the disclosed embodiments or constructions. To the contrary, the invention is intended to cover various modifications and equivalent arrangements. For example, although in the first to third embodiments, the control using the total required amount of fuel TFFF based on the amount of change of the target pressure is applied to an intake adjusting-type two-lobe cam pump, it is also possible to apply the TFFF control to a pre-stroke-type four-lobe cam pump.

As understood from the foregoing description, the invention advantageously improves the controllability of common rail pressure during the control of the amount of fuel pumped by the fuel pump, so that, for example, a two-lobe cam pump can be used to supply fuel to a common rail of an internal combustion engine.

What is claimed is:

1. A fluid pump control apparatus for pumping fluid from a fluid pump to a pressure accumulating chamber that holds pressurized fluid, the fluid pump control apparatus comprising:

a first control means for setting a basic fluid pumping amount to be pumped by the fluid pump on a basis of a target value of pressure in the pressure accumulating chamber;

a second control means for calculating a required fluid pumping amount required to adjust pressure on the pressure accumulating chamber from a present level to a target pressure;

a setting means for setting a sum of a total required amount of fluid that includes the required fluid pumping amount calculated by the second control means and the basic fluid pumping amount of the fluid pump set by the first control means, as a set value of fluid pumping amount to be pumped by the fluid pump; and a carried-over amount setting means for, if the set value of the fluid pumping amount set by the setting means exceeds a predetermined fluid pumping amount of the fluid pump, setting a carried-over amount of fluid by which the set value of the fluid pumping amount exceeds the predetermined fluid pumping amount, the carried-over amount of fluid being carried over to a next setting of the fluid pumping amount wherein the entire required fluid pumping amount not supplied by a first fluid pumping stroke, is carried over to be supplied by a next fluid pumping stroke by summing the carried-over amount of fluid in combination with a base fuel pumping amount.

2. A fluid pump control apparatus according to claim 1, wherein the total required amount of fluid is a sum of the required fluid pumping amount and the carried-over amount.

3. A fluid pump control apparatus according to claim 2, wherein the setting means sets the basic fluid pumping amount as the set value of fluid pumping amount and the carried-over amount setting device sets the carried-over amount to zero when the total required amount of fluid is less than a predetermined amount.

4. A fluid pump control apparatus according to claim 3, further comprising:

a prediction means for calculating a predicted pressure in the pressure accumulating chamber that occurs before starting a next fluid pumping operation, on a basis of a pressure in the pressure accumulating chamber that occurs before starting a present fluid pumping operation, an amount of fluid ejected from the pressure accumulating chamber, and a fluid pumping amount;

a prediction feedback means for setting a prediction feedback amount for the fluid pumping amount on the basis of the target value of pressure and the predicted pressure in the pressure accumulating chamber predicted by the prediction means, in such a manner that the pressure in the pressure accumulating chamber occurring at an ending time of the next fluid pumping operation becomes substantially equal to the target value of pressure; and a correction means for correcting the fluid pumping amount to be pumped during the next fluid pumping operation which fluid pumping amount is set by the setting means by using the predicted feedback amount.

5. A fluid pump control apparatus according to claim 1, further comprises a third control means for setting a feedback correction amount for the fluid pumping amount on a basis of the target value of pressure and a present actual pressure in the pressure accumulating chamber, in such a manner that the actual pressure in the pressure accumulating chamber becomes substantially equal to the target value of pressure, wherein if the total required amount of fluid equals or exceeds the predetermined fluid pumping amount, the third control means sets the feedback correction amount so that the feedback correction amount becomes smaller than if the total required amount of fluid is less than the predetermined fluid pumping amount, and the setting means sets as the set value of the fluid pumping amount a sum of the basic fluid pumping amount set by the first control means, the total required amount of fluid, and the feedback correction amount.

6. A fluid pump control apparatus according to claim 1 further comprises third control means for setting a feedback correction amount for a fluid pumping amount on a basis of the target value of pressure and a present actual pressure in the pressure accumulating chamber, in such a manner that the actual pressure in the pressure accumulating chamber becomes substantially equal to the target value of pressure, wherein the setting means sets as the set value of the fluid pumping amount a sum of the basic fluid pumping amount set by the first control means and the feedback correction amount set by the third control means when the total required amount of fluid is less than the predetermined fluid pumping amount.

7. A fluid pump control apparatus for pumping pressurized fluid from a fluid pump to a pressure accumulating chamber connected to a fluid injection valve of an internal combustion engine, the fluid pump control apparatus comprising:

a feedback control means for setting a fluid pumping amount to be pumped by the fluid pump on a basis of a target value of pressure in the pressure accumulating chamber and an actual pressure in the pressure accumulating chamber, in such a manner that the actual pressure in the pressure accumulating chamber becomes substantially equal to the target value of pressure; and a prediction means for calculating a pressure in the pressure accumulating chamber that occurs before starting a next fluid pumping operation, on a basis of fluid injection amount, a fluid pumping amount, and a pressure in the pressure accumulating chamber occurring before starting a present fluid pumping operation, wherein the feedback control means uses the predicted pressure in the pressure accumulating chamber predicted by the prediction means, instead of the actual pressure in the pressure accumulating chamber, to set a fluid pumping amount to be pumped by the next fluid pumping operation wherein an entire required fluid pumping amount not supplied by a first fluid pumping stroke, is carried over to be supplied by a next fluid pumping stroke by summing the carried-over amount of fluid in combination with a base fuel pumping amount.

8. A fluid pump control apparatus according to claim 7, wherein the feedback control means uses the actual pressure in the pressure accumulating chamber to set the fluid pumping amount to be pumped by the next fluid pumping operation when a deviation of the actual pressure in the pressure accumulating chamber from the target value of pressure is smaller than a predetermined value.

9. A fluid pump control method for pumping fluid from a fluid pump to a pressure accumulating chamber that holds pressurized fluid, comprising:

setting a basic fluid pumping amount to be pumped by the fluid pump on a basis of a target value of pressure in the pressure accumulating chamber;

calculating a required fluid pumping amount required to adjust pressure in the pressure accumulating chamber from a present pressure to the target value of pressure;

setting a sum of a total required amount of fluid that includes the required fluid pumping amount calculated in the calculating step, and the basic fluid pumping amount of the fluid pump set on a basis of the target value of pressure, as a set value of a fluid pumping amount to be pumped by the fluid pump; and setting a carried-over amount by which the set value of the fluid pumping amount exceeds a predetermined fluid amount of the fluid pump, the carried-over amount being carried over to a next setting of the fluid pumping amount, if the set value of the fluid pumping amount exceeds the predetermined fluid pumping amount such that if an entire required fluid pumping amount cannot be supplied by a first fluid pumping stroke, then that amount of fluid not supplied is carried over to be supplied by a next fluid pumping stroke by summing the carried-over amount of fluid in combination with a base fuel pumping amount.

10. A fluid pump control method according to claim 9, wherein the total required amount of fluid is a sum of the required fluid pumping amount and the carried-over amount.

11. A fluid pump control method according to claim 10, wherein the basic fluid pumping amount is set as the set value of fluid pumping amount and the carried-over amount is set to zero when the total required amount of fluid is less than the predetermined fluid pumping amount.

12. A fluid pump control method according to claim 11, further comprising:

predicting a pressure in the pressure accumulating chamber that occurs before starting a next fluid pumping operation, on a basis of a pressure in the pressure accumulating chamber that occurs before starting a present fluid pumping operation, an amount of fluid ejected from the pressure accumulating chamber, and the fluid pumping amount;

setting a predicted feedback amount for the fluid pumping amount on a basis of the target value of pressure and the predicted pressure in the pressure accumulating chamber, in such a manner that the pressure in the pressure accumulating chamber occurring at an ending time of the next fluid pumping operation becomes substantially equal to the target value of pressure; and correcting the set value of the fluid pumping amount to be pumped during the next operation, by using the predicted feedback amount.

13. A fluid pump control method according to claim 9, further comprising:

setting a feedback correction amount for the fluid pumping amount on a basis of the target value of pressure and an actual pressure in the pressure accumulating chamber, in such a manner that the actual pressure in the pressure accumulating chamber becomes substantially equal to the target value of pressure, wherein if the total required amount of fluid equals or exceeds the predetermined fluid pumping amount, the feedback correction amount is set so that the feedback correction amount becomes smaller than if the total required amount of fluid is less than the predetermined fluid pumping amount, and a sum of the basic fluid pumping amount, the total required amount of fluid and the feedback correction amount is set as the set value of the fluid pumping amount.

14. A fluid pump control method according to claim 9, further comprising:

setting a feedback correction amount for the fluid pumping amount on a basis of the target value of pressure in the pressure accumulating chamber and an actual pressure in the pressure accumulating chamber, in such a manner that the actual pressure in the pressure accumulating chamber becomes substantially equal to the target value of pressure, wherein a sum of the basic fluid pumping amount and the feedback correction amount is set as the set value of the fluid pumping amount when the total required amount of fluid is less than the predetermined fluid pumping amount.

15. A fluid pump control method for pumping pressurized fluid from a fluid pump to a pressure accumulating chamber connected to a fluid injection valve of an internal combustion engine, the fluid pump control method comprising:

setting a fluid pumping amount to be pumped by the fluid pump through feedback control on a basis of a target value of pressure in the pressure accumulating chamber and an actual pressure in the pressure accumulating chamber, in such a manner that the actual pressure in the pressure accumulating chamber becomes substantially equal to the target value of pressure and such that if an entire required fluid pumping amount cannot be supplied by a first fluid pumping stroke, then that amount of fluid not supplied is carried over to be supplied by a next fluid pumping stroke by summing the carried-over amount of fluid in combination with a base fuel pumping amount; and predicting a pressure in the pressure accumulating chamber that occurs before starting a next fluid pumping operation, on a basis of a fluid injection amount, the fluid pumping amount, and a pressure in the pressure accumulating chamber that occurs before starting a present fluid pumping operation, wherein the predicted pressure in the pressure accumulating chamber predicted in the predicting step is used to generate feedback, instead of the actual pressure in the pressure accumulating chamber, to set the fluid pumping amount to be pumped by the next fluid pumping operation.

16. A fluid pump control method according to claim 15, wherein the actual pressure in the pressure accumulating chamber is used to generate feedback to set the fluid pumping amount to be pumped by the next fluid pumping operation if a deviation of the actual pressure in the pressure accumulating chamber from the target value of pressure is smaller than a predetermined value of pressure.

* * * * *